US011835909B2

(12) United States Patent
Nakajima et al.

(10) Patent No.: US 11,835,909 B2
(45) Date of Patent: Dec. 5, 2023

(54) IMAGE FORMING APPARATUS INCLUDING HEATER POWERED WITH CYCLE-SWITCHED CURRENT AND FIXING DEVICE INCLUDING THE HEATER

(71) Applicant: CANON KABUSHIKI KAISHA, Tokyo (JP)

(72) Inventors: Nozomu Nakajima, Kanagawa (JP); Atsushi Nakamoto, Tokyo (JP); Kohei Wakatsu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/741,345

(22) Filed: May 10, 2022

(65) Prior Publication Data

US 2022/0365475 A1 Nov. 17, 2022

(30) Foreign Application Priority Data

May 17, 2021 (JP) ..... 2021-083234

(51) Int. Cl.
*G03G 15/00* (2006.01)

(52) U.S. Cl.
CPC ..... *G03G 15/80* (2013.01)

(58) Field of Classification Search
USPC ..... 399/88
See application file for complete search history.

(56) References Cited

U.S. PATENT DOCUMENTS 11,156,945 B2 10/2021 Nakajima et al. . G03G 15/2042
11,281,135 B2 3/2022 Sato et al. ..... G03G 15/2039
2012/0230742 A1 9/2012 Nakagawa et al. .... G03G 15/20
2012/0243894 A1 9/2012 Umeda et al. ..... G03G 15/20
2015/0331371 A1 11/2015 Nakajima ..... G03G 15/20
2016/0033908 A1 2/2016 Tsunashima et al. .. G03G 15/20
2016/0327894 A1 11/2016 Tsunashima et al. .. G03G 15/20
(Continued)

FOREIGN PATENT DOCUMENTS

JP 2014-232247 12/2014
JP 2016-180913 10/2016
(Continued)

OTHER PUBLICATIONS

U.S. Appl. No. 17/882,455, filed Aug. 5, 2022.
U.S. Appl. No. 17/882,491, filed Aug. 5, 2022.
U.S. Appl. No. 17/884,480, filed Aug. 9, 2022.

*Primary Examiner* — Quana Grainger
(74) *Attorney, Agent, or Firm* — Venable LLP

(57) ABSTRACT

An image forming apparatus includes a first rotating member, a heater, a second rotating member, a detecting unit, a switching unit, a controlling unit, and a power source device. In a first period, a resultant current of first and third currents is supplied to a first heat generating element, and the resultant current in a unit cycle of a first period is a current at which a first current supplying timing and timings of a maximum and a minimum of the third current do not overlap with each other. In a second period, a resultant current of second and third currents is supplied to a second heat generating element, and the resultant current in a unit cycle of the second period is a current at which a second current supplying timing and the timings of the maximum and the minimum of the third current overlap with each other.

18 Claims, 17 Drawing Sheets

(56) References Cited

U.S. PATENT DOCUMENTS

| | | | | |
|---|---|---|---|---|
| 2016/0342117 | A1 | 11/2016 | Minamishima et al. | G03G 15/20 |
| 2017/0060052 | A1 | 3/2017 | Narahara et al. | G03G 15/20 |
| 2017/0315485 | A1 | 11/2017 | Tsunashima et al. | G03G 15/20 |
| 2017/0343929 | A1 | 11/2017 | Narahara et al. | G03G 15/20 |
| 2018/0074444 | A1 | 3/2018 | Wakatsu et al. | G03G 15/20 |
| 2018/0074445 | A1 | 3/2018 | Nishida et al. | G03G 15/20 |
| 2018/0173140 | A1 | 6/2018 | Imaizumi et al. | G03G 15/20 |
| 2018/0181039 | A1 | 6/2018 | An et al. | G03G 15/20 |
| 2018/0348678 | A1 | 12/2018 | Nakamoto et al. | G03G 15/20 |
| 2018/0373189 | A1 | 12/2018 | Wakatsu et al. | G03G 15/20 |
| 2019/0171145 | A1 | 6/2019 | Lmaizumi et al. | G03G 15/20 |
| 2020/0233346 | A1 | 7/2020 | Sato et al. | G03G 15/20 |
| 2020/0233348 | A1 | 7/2020 | Nakajima et al. | G03G 15/20 |
| 2020/0233350 | A1 | 7/2020 | Oi et al. | G03G 15/20 |
| 2020/0233352 | A1 | 7/2020 | Doda et al. | G03G 15/20 |
| 2020/0249600 | A1 | 8/2020 | Yoshida et al. | G03G 15/20 |
| 2020/0301330 | A1 | 9/2020 | Yoshida et al. | G03G 15/20 |
| 2020/0371459 | A1 | 11/2020 | Takeda et al. | G03G 15/20 |
| 2021/0063923 | A1 | 3/2021 | Odate et al. | G03G 15/20 |
| 2021/0072680 | A1 | 3/2021 | Yoshida et al. | G03G 15/20 |
| 2021/0072684 | A1 | 3/2021 | Doda et al. | G03G 15/20 |
| 2021/0132528 | A1 | 5/2021 | Sato et al. | G03G 15/20 |
| 2021/0165351 | A1 | 6/2021 | Doda et al. | G03G 15/20 |
| 2021/0232072 | A1 | 7/2021 | Nakajima et al. | G03G 15/20 |
| 2021/0278793 | A1* | 9/2021 | Maeda | G03G 15/2042 |
| 2021/0278794 | A1 | 9/2021 | Nakajima | G03G 15/00 |
| 2021/0333732 | A1 | 10/2021 | Yoshida et al. | G03G 15/20 |
| 2021/0333733 | A1 | 10/2021 | Doda et al. | G03G 15/20 |
| 2022/0057736 | A1 | 2/2022 | Doda et al. | G03G 15/20 |
| 2022/0100128 | A1 | 3/2022 | Nakamoto et al. | G03G 15/20 |
| 2022/0253006 | A1 | 8/2022 | Doda et al. | G03G 15/20 |
| 2022/0299912 | A1 | 9/2022 | Yoshida et al. | G03G 15/20 |
| 2022/0299914 | A1 | 9/2022 | Doda | G03G 15/20 |
| 2022/0308509 | A1 | 9/2022 | Wakatsu et al. | G03G 15/20 |

FOREIGN PATENT DOCUMENTS

| | | |
|---|---|---|
| JP | 2020-115185 | 7/2020 |
| JP | 2020-115186 | 7/2020 |

* cited by examiner

[A]

[B]

| TIMING n | 1 | 2 | 3 | 4 | 5 | 6 | |
|---|---|---|---|---|---|---|---|
| SUPPLY POWER RATIO | Duty 70% | Duty 40% | Duty 40% | Duty 60% | Duty 40% | Duty 30% | |
| MAXIMUM CURRENT VALUE | 7.1A | 5.7A | 5.7A | 7.1A | 7.2A | 6.8A | |
| NAME OF SUPPLY PERIOD | FIRST | SECOND | | | FIRST | | SECOND |
| SELECTED HEATING ELEMENT | 54b1 | 54b3 | | | 54b1 | | 54b3 |
| COMPARISON CURRENT VALUE | | MAXIMUM CURRENT VALUE 7.1A | | | MAXIMUM CURRENT AVERAGE 7.0A | | |

Table 1

| | AVERAGE TARGET INPUT ELECTRIC POWER DUTY [%] IN CONTROL CYCLE (8 HWs) | HALF WAVES OF COMMERCIAL AC POWER SOURCE 101 | | | | | | | |
|---|---|---|---|---|---|---|---|---|---|
| | | 1 | 2 | 3 | 4 | 5 | 6 | 7 | 8 |
| | | ELECTRIC POWER DUTY [%] IN ASSOCIATED HALF WAVE | | | | | | | |
| SECTION 1 | 0.00 | 0.00 | 0.00 | 0.00 | 0.00 | 0.00 | 0.00 | 0.00 | 0.00 |
| | 2.50 | 0.00 | 0.00 | 10.00 | 0.00 | 0.00 | 10.00 | 0.00 | 0.00 |
| | 5.00 | 0.00 | 0.00 | 20.00 | 0.00 | 0.00 | 20.00 | 0.00 | 0.00 |
| | 7.50 | 0.00 | 0.00 | 30.00 | 0.00 | 0.00 | 30.00 | 0.00 | 0.00 |
| | 10.00 | 10.00 | 10.00 | 10.00 | 10.00 | 10.00 | 10.00 | 10.00 | 10.00 |
| | 12.50 | 12.50 | 12.50 | 12.50 | 12.50 | 12.50 | 12.50 | 12.50 | 12.50 |
| | 15.00 | 15.00 | 15.00 | 15.00 | 15.00 | 15.00 | 15.00 | 15.00 | 15.00 |
| | 17.50 | 17.50 | 17.50 | 17.50 | 17.50 | 17.50 | 17.50 | 17.50 | 17.50 |
| | 20.00 | 20.00 | 20.00 | 20.00 | 20.00 | 20.00 | 20.00 | 20.00 | 20.00 |
| | 22.50 | 22.50 | 22.50 | 22.50 | 22.50 | 22.50 | 22.50 | 22.50 | 22.50 |
| | 25.00 | 25.00 | 25.00 | 25.00 | 25.00 | 25.00 | 25.00 | 25.00 | 25.00 |
| | 27.50 | 27.50 | 27.50 | 27.50 | 27.50 | 27.50 | 27.50 | 27.50 | 27.50 |
| | 30.00 | 30.00 | 30.00 | 30.00 | 30.00 | 30.00 | 30.00 | 30.00 | 30.00 |
| | 32.50 | 32.50 | 32.50 | 32.50 | 32.50 | 32.50 | 32.50 | 32.50 | 32.50 |
| | 35.00 | 35.00 | 35.00 | 35.00 | 35.00 | 35.00 | 35.00 | 35.00 | 35.00 |
| | 37.50 | 37.50 | 37.50 | 37.50 | 37.50 | 37.50 | 37.50 | 37.50 | 37.50 |
| | 40.00 | 40.00 | 40.00 | 40.00 | 40.00 | 40.00 | 40.00 | 40.00 | 40.00 |
| | 42.50 | 42.50 | 42.50 | 42.50 | 42.50 | 42.50 | 42.50 | 42.50 | 42.50 |
| SECTION 2 | 45.00 | 26.25 | 26.25 | 100.00 | 26.25 | 26.25 | 100.00 | 26.25 | 26.25 |
| | 47.50 | 30.00 | 30.00 | 100.00 | 30.00 | 30.00 | 100.00 | 30.00 | 30.00 |
| | 50.00 | 33.75 | 33.75 | 100.00 | 33.75 | 33.75 | 100.00 | 33.75 | 33.75 |
| | 52.50 | 36.25 | 36.25 | 100.00 | 36.25 | 36.25 | 100.00 | 36.25 | 36.25 |
| | 55.00 | 40.00 | 40.00 | 100.00 | 40.00 | 40.00 | 100.00 | 40.00 | 40.00 |
| | 57.50 | 43.75 | 43.75 | 100.00 | 43.75 | 43.75 | 100.00 | 43.75 | 43.75 |
| | 60.00 | 100.00 | 20.00 | 100.00 | 20.00 | 20.00 | 100.00 | 20.00 | 100.00 |
| | 62.50 | 100.00 | 25.00 | 100.00 | 25.00 | 25.00 | 100.00 | 25.00 | 100.00 |
| | 65.00 | 100.00 | 30.00 | 100.00 | 30.00 | 30.00 | 100.00 | 30.00 | 100.00 |
| | 67.50 | 100.00 | 35.00 | 100.00 | 35.00 | 35.00 | 100.00 | 35.00 | 100.00 |
| | 70.00 | 100.00 | 40.00 | 100.00 | 40.00 | 40.00 | 100.00 | 40.00 | 100.00 |
| | 72.50 | 100.00 | 45.00 | 100.00 | 45.00 | 45.00 | 100.00 | 45.00 | 100.00 |
| SECTION 3 | 75.00 | 75.00 | 75.00 | 75.00 | 75.00 | 75.00 | 75.00 | 75.00 | 75.00 |
| | 77.50 | 77.50 | 77.50 | 77.50 | 77.50 | 77.50 | 77.50 | 77.50 | 77.50 |
| | 80.00 | 80.00 | 80.00 | 80.00 | 80.00 | 80.00 | 80.00 | 80.00 | 80.00 |
| | 82.50 | 82.50 | 82.50 | 82.50 | 82.50 | 82.50 | 82.50 | 82.50 | 82.50 |
| | 85.00 | 85.00 | 85.00 | 85.00 | 85.00 | 85.00 | 85.00 | 85.00 | 85.00 |
| | 87.50 | 87.50 | 87.50 | 87.50 | 87.50 | 87.50 | 87.50 | 87.50 | 87.50 |
| | 90.00 | 90.00 | 90.00 | 90.00 | 90.00 | 90.00 | 90.00 | 90.00 | 90.00 |
| | 92.50 | 92.50 | 92.50 | 92.50 | 92.50 | 92.50 | 92.50 | 92.50 | 92.50 |
| | 95.00 | 95.00 | 95.00 | 95.00 | 95.00 | 95.00 | 95.00 | 95.00 | 95.00 |
| | 97.50 | 97.50 | 97.50 | 97.50 | 97.50 | 97.50 | 97.50 | 97.50 | 97.50 |
| | 100.00 | 100.00 | 100.00 | 100.00 | 100.00 | 100.00 | 100.00 | 100.00 | 100.00 |

FIG. 15

Table 2

| AVERAGE TARGET INPUT ELECTRIC POWER DUTY [%] IN CONTROL CYCLE (8 HWs) | HALF WAVES OF COMMERCIAL AC POWER SOURCE 101 | | | | | | | |
|---|---|---|---|---|---|---|---|---|
| | 1 | 2 | 3 | 4 | 5 | 6 | 7 | 8 |
| | ELECTRIC POWER DUTY [%] IN ASSOCIATED HALF WAVE | | | | | | | |
| 0.00 | 0.00 | 0.00 | 0.00 | 0.00 | 0.00 | 0.00 | 0.00 | 0.00 |
| 2.50 | 0.00 | 0.00 | 10.00 | 0.00 | 0.00 | 10.00 | 0.00 | 0.00 |
| 5.00 | 0.00 | 0.00 | 20.00 | 0.00 | 0.00 | 20.00 | 0.00 | 0.00 |
| 7.50 | 0.00 | 0.00 | 30.00 | 0.00 | 0.00 | 30.00 | 0.00 | 0.00 |
| 10.00 | 10.00 | 10.00 | 10.00 | 10.00 | 10.00 | 10.00 | 10.00 | 10.00 |
| 12.50 | 12.50 | 12.50 | 12.50 | 12.50 | 12.50 | 12.50 | 12.50 | 12.50 |
| 15.00 | 15.00 | 15.00 | 15.00 | 15.00 | 15.00 | 15.00 | 15.00 | 15.00 |
| 17.50 | 17.50 | 17.50 | 17.50 | 17.50 | 17.50 | 17.50 | 17.50 | 17.50 |
| 20.00 | 20.00 | 20.00 | 20.00 | 20.00 | 20.00 | 20.00 | 20.00 | 20.00 |
| 22.50 | 22.50 | 22.50 | 22.50 | 22.50 | 22.50 | 22.50 | 22.50 | 22.50 |
| 25.00 | 25.00 | 25.00 | 25.00 | 25.00 | 25.00 | 25.00 | 25.00 | 25.00 |
| 27.50 | 27.50 | 27.50 | 27.50 | 27.50 | 27.50 | 27.50 | 27.50 | 27.50 |
| 30.00 | 30.00 | 30.00 | 30.00 | 30.00 | 30.00 | 30.00 | 30.00 | 30.00 |
| 32.50 | 32.50 | 32.50 | 32.50 | 32.50 | 32.50 | 32.50 | 32.50 | 32.50 |
| 35.00 | 35.00 | 35.00 | 35.00 | 35.00 | 35.00 | 35.00 | 35.00 | 35.00 |
| 37.50 | 37.50 | 37.50 | 37.50 | 37.50 | 37.50 | 37.50 | 37.50 | 37.50 |
| 40.00 | 40.00 | 40.00 | 40.00 | 40.00 | 40.00 | 40.00 | 40.00 | 40.00 |
| 42.50 | 42.50 | 42.50 | 42.50 | 42.50 | 42.50 | 42.50 | 42.50 | 42.50 |
| 45.00 | 45.00 | 45.00 | 45.00 | 45.00 | 45.00 | 45.00 | 45.00 | 45.00 |
| 47.50 | 47.50 | 47.50 | 47.50 | 47.50 | 47.50 | 47.50 | 47.50 | 47.50 |
| 50.00 | 50.00 | 50.00 | 50.00 | 50.00 | 50.00 | 50.00 | 50.00 | 50.00 |
| 52.50 | 52.50 | 52.50 | 52.50 | 52.50 | 52.50 | 52.50 | 52.50 | 52.50 |
| 55.00 | 55.00 | 55.00 | 55.00 | 55.00 | 55.00 | 55.00 | 55.00 | 55.00 |
| 57.50 | 57.50 | 57.50 | 57.50 | 57.50 | 57.50 | 57.50 | 57.50 | 57.50 |
| 60.00 | 60.00 | 60.00 | 60.00 | 60.00 | 60.00 | 60.00 | 60.00 | 60.00 |
| 62.50 | 62.50 | 62.50 | 62.50 | 62.50 | 62.50 | 62.50 | 62.50 | 62.50 |
| 65.00 | 65.00 | 65.00 | 65.00 | 65.00 | 65.00 | 65.00 | 65.00 | 65.00 |
| 67.50 | 67.50 | 67.50 | 67.50 | 67.50 | 67.50 | 67.50 | 67.50 | 67.50 |
| 70.00 | 70.00 | 70.00 | 70.00 | 70.00 | 70.00 | 70.00 | 70.00 | 70.00 |
| 72.50 | 72.50 | 72.50 | 72.50 | 72.50 | 72.50 | 72.50 | 72.50 | 72.50 |
| 75.00 | 75.00 | 75.00 | 75.00 | 75.00 | 75.00 | 75.00 | 75.00 | 75.00 |
| 77.50 | 77.50 | 77.50 | 77.50 | 77.50 | 77.50 | 77.50 | 77.50 | 77.50 |
| 80.00 | 80.00 | 80.00 | 80.00 | 80.00 | 80.00 | 80.00 | 80.00 | 80.00 |
| 82.50 | 82.50 | 82.50 | 82.50 | 82.50 | 82.50 | 82.50 | 82.50 | 82.50 |
| 85.00 | 85.00 | 85.00 | 85.00 | 85.00 | 85.00 | 85.00 | 85.00 | 85.00 |
| 87.50 | 87.50 | 87.50 | 87.50 | 87.50 | 87.50 | 87.50 | 87.50 | 87.50 |
| 90.00 | 90.00 | 90.00 | 90.00 | 90.00 | 90.00 | 90.00 | 90.00 | 90.00 |
| 92.50 | 92.50 | 92.50 | 92.50 | 92.50 | 92.50 | 92.50 | 92.50 | 92.50 |
| 95.00 | 95.00 | 95.00 | 95.00 | 95.00 | 95.00 | 95.00 | 95.00 | 95.00 |
| 97.50 | 97.50 | 97.50 | 97.50 | 97.50 | 97.50 | 97.50 | 97.50 | 97.50 |
| 100.00 | 100.00 | 100.00 | 100.00 | 100.00 | 100.00 | 100.00 | 100.00 | 100.00 |

FIG. 16

Table 4

| | AVERAGE TARGET INPUT ELECTRIC POWER DUTY [%] IN CONTROL CYCLE (8 HWs) | HALF WAVES OF COMMERCIAL AC POWER SOURCE 101 | | | | | | | | PHASE ANGLE [deg] | |
|---|---|---|---|---|---|---|---|---|---|---|---|
| | | 1 | 2 | 3 | 4 | 5 | 6 | 7 | 8 | | |
| | | ELECTRIC POWER DUTY [%] IN ASSOCIATED HALF WAVE | | | | | | | | POSITIVE | NEGATIVE |
| | 0.00 | 0.00 | 0.00 | 0.00 | 0.00 | 0.00 | 0.00 | 0.00 | 0.00 | 180 | 360 |
| | 2.50 | 0.00 | 0.00 | 10.00 | 0.00 | 0.00 | 10.00 | 0.00 | 0.00 | | |
| | 5.00 | 0.00 | 0.00 | 20.00 | 0.00 | 0.00 | 20.00 | 0.00 | 0.00 | | |
| | 7.50 | 0.00 | 0.00 | 30.00 | 0.00 | 0.00 | 30.00 | 0.00 | 0.00 | | |
| | 10.00 | 10.00 | 10.00 | 10.00 | 10.00 | 10.00 | 10.00 | 10.00 | 10.00 | | |
| | 12.50 | 12.50 | 12.50 | 12.50 | 12.50 | 12.50 | 12.50 | 12.50 | 12.50 | | |
| | 15.00 | 15.00 | 15.00 | 15.00 | 15.00 | 15.00 | 15.00 | 15.00 | 15.00 | | |
| | 17.50 | 17.50 | 17.50 | 17.50 | 17.50 | 17.50 | 17.50 | 17.50 | 17.50 | | |
| | 20.00 | 20.00 | 20.00 | 20.00 | 20.00 | 20.00 | 20.00 | 20.00 | 20.00 | | |
| SECTION 4 | 22.50 | 22.50 | 22.50 | 22.50 | 22.50 | 22.50 | 22.50 | 22.50 | 22.50 | | |
| | 25.00 | 25.00 | 25.00 | 25.00 | 25.00 | 25.00 | 25.00 | 25.00 | 25.00 | | |
| | 27.50 | 27.50 | 27.50 | 27.50 | 27.50 | 27.50 | 27.50 | 27.50 | 27.50 | | |
| | 30.00 | 30.00 | 30.00 | 30.00 | 30.00 | 30.00 | 30.00 | 30.00 | 30.00 | | |
| | 32.50 | 32.50 | 32.50 | 32.50 | 32.50 | 32.50 | 32.50 | 32.50 | 32.50 | | |
| | 35.00 | 35.00 | 35.00 | 35.00 | 35.00 | 35.00 | 35.00 | 35.00 | 35.00 | | |
| | 37.50 | 37.50 | 37.50 | 37.50 | 37.50 | 37.50 | 37.50 | 37.50 | 37.50 | | |
| | 40.00 | 40.00 | 40.00 | 40.00 | 40.00 | 40.00 | 40.00 | 40.00 | 40.00 | | |
| | 42.50 | 42.50 | 42.50 | 42.50 | 42.50 | 42.50 | 42.50 | 42.50 | 42.50 | | |
| | 45.00 | 45.00 | 45.00 | 45.00 | 45.00 | 45.00 | 45.00 | 45.00 | 45.00 | | |
| | 47.50 | 47.50 | 47.50 | 47.50 | 47.50 | 47.50 | 47.50 | 47.50 | 47.50 | | |
| | 50.00 | 50.00 | 50.00 | 50.00 | 50.00 | 50.00 | 50.00 | 50.00 | 50.00 | 90 | 270 |
| | 52.50 | 52.50 | 52.50 | 52.50 | 52.50 | 52.50 | 52.50 | 52.50 | 52.50 | | |
| | 55.00 | 55.00 | 55.00 | 55.00 | 55.00 | 55.00 | 55.00 | 55.00 | 55.00 | | |
| | 57.50 | 57.50 | 57.50 | 57.50 | 57.50 | 57.50 | 57.50 | 57.50 | 57.50 | | |
| | 60.00 | 60.00 | 60.00 | 60.00 | 60.00 | 60.00 | 60.00 | 60.00 | 60.00 | | |
| | 62.50 | 62.50 | 62.50 | 62.50 | 62.50 | 62.50 | 62.50 | 62.50 | 62.50 | | |
| | 65.00 | 65.00 | 65.00 | 65.00 | 65.00 | 65.00 | 65.00 | 65.00 | 65.00 | | |
| | 67.50 | 67.50 | 67.50 | 67.50 | 67.50 | 67.50 | 67.50 | 67.50 | 67.50 | | |
| | 70.00 | 70.00 | 70.00 | 70.00 | 70.00 | 70.00 | 70.00 | 70.00 | 70.00 | | |
| | 72.50 | 72.50 | 72.50 | 72.50 | 72.50 | 72.50 | 72.50 | 72.50 | 72.50 | | |
| SECTION 5 | 75.00 | 75.00 | 75.00 | 75.00 | 75.00 | 75.00 | 75.00 | 75.00 | 75.00 | | |
| | 77.50 | 77.50 | 77.50 | 77.50 | 77.50 | 77.50 | 77.50 | 77.50 | 77.50 | | |
| | 80.00 | 80.00 | 80.00 | 80.00 | 80.00 | 80.00 | 80.00 | 80.00 | 80.00 | | |
| | 82.50 | 82.50 | 82.50 | 82.50 | 82.50 | 82.50 | 82.50 | 82.50 | 82.50 | | |
| | 85.00 | 85.00 | 85.00 | 85.00 | 85.00 | 85.00 | 85.00 | 85.00 | 85.00 | | |
| | 87.50 | 87.50 | 87.50 | 87.50 | 87.50 | 87.50 | 87.50 | 87.50 | 87.50 | | |
| | 90.00 | 90.00 | 90.00 | 90.00 | 90.00 | 90.00 | 90.00 | 90.00 | 90.00 | | |
| | 92.50 | 92.50 | 92.50 | 92.50 | 92.50 | 92.50 | 92.50 | 92.50 | 92.50 | | |
| | 95.00 | 95.00 | 95.00 | 95.00 | 95.00 | 95.00 | 95.00 | 95.00 | 95.00 | | |
| | 97.50 | 97.50 | 97.50 | 97.50 | 97.50 | 97.50 | 97.50 | 97.50 | 97.50 | | |
| | 100.00 | 100.00 | 100.00 | 100.00 | 100.00 | 100.00 | 100.00 | 100.00 | 100.00 | 0 | 180 |

FIG. 17

IMAGE FORMING APPARATUS INCLUDING HEATER POWERED WITH CYCLE-SWITCHED CURRENT AND FIXING DEVICE INCLUDING THE HEATER

FIELD OF THE INVENTION AND RELATED ART

The present invention relates to an image forming apparatus and a fixing device for use in the image forming apparatus.

The image forming apparatus for forming an image on a recording material includes the fixing device for fixing a toner image, transferred on the recording material, on the recording material by heating and pressing the toner image. In the fixing device, a heating device using a ceramic heater as a heat generating source for heating the recording material is included. A technique in which the heating device includes a plurality of heat generating elements different in length in a widthwise direction (longitudinal direction of the ceramic heater) which is a direction substantially perpendicular to a recording material feeding direction and in which a performance is maximized by switching a heat generation timing of each of the heat generating elements has been proposed in Japanese Laid-Open Patent Application (JP-A) 2020-115185 and JP-A 2020-115186, and the like. In JP-A 2020-115185 and JP-A 2020-115186, the technique in which the heat generating elements different in length in the widthwise direction of the recording material are exclusively switched at high frequency to suppress a temperature rise of non-sheet-passing portion of the heat generating elements where the recording material does not pass has been proposed. By this, a printing speed of B5-size recording material or an A5-size recording material which are narrow in width is made fast, so that productivity for a small-size recording material is improved.

Further, in control in which the plurality of heat generating elements are excessively switched, it has been known that at a timing when the heat generating elements to which the electric power is supplied are switched, an AC voltage of a commercial AC power source as a current supplying source fluctuates and thus flicker (flickering) occurs.

Conventionally, as a factor of the occurrence of the flicker, a current flowing through the heat generating elements is changed by switching the heat generating elements to which the electric power is supplied and thus the AC voltage of the power source fluctuates in some instances. Further, a frequency at which the current is changed is typically around 8.8 kHz, corresponding to the frequency of switching the heat generating elements to which the electric power is supplied, which in some instances causes discomfort to users. Thus, it is required that the flicker which occurs as described above is suppressed.

SUMMARY OF THE INVENTION

According to an aspect of the present invention, there is provided an image forming apparatus comprising: a first rotating member; a heater which includes a first heat generating element and a second heat generating element larger in resistance value than the first heat generating element, which is provided in an inner space of the first rotating member, and which is configured to heat the first rotating member; a second rotating member configured to form a nip in cooperation with the first rotating member; a detecting unit configured to detect a temperature of the heater; a switching unit configured to switch an electric power supply passage from an AC power source to the first heat generating element or the second heat generating element; a controlling unit configured to control the switching unit so as to supply electric power to the first heat generating element or the second heat generating element; and a power source device configured to generate a DC voltage from an AC voltage supplied from the AC power source, wherein the first heat generating element, the second heat generating element, and the power source device are connected to the AC power source in parallel so that a first current is supplied from the AC power source to the first heat generating element, a second current is supplied from the AC power source to the second heat generating element, and a third current is supplied from the AC power source to the power source device, wherein on the basis of the temperature of the heater detected by the detecting unit and a target temperature of the heater, the controlling unit carries out control so that the electric power is supplied to the first heat generating element in a first period including a plurality of unit periods through phase control and so that the electric power is supplied to the second heat generating element in a second period including a plurality of unit periods through the phase control, wherein the switching unit switches the electric power passage to switch the first period to the second period or the second period to the first period, wherein in the first period, a resultant current of the first current and the third current is supplied to the first heat generating element, and the resultant current in at least one of the unit periods of the first period is a current at which a timing when the first current is supplied and timings of a maximum and a minimum of the third current do not overlap with each other, and wherein in the second period, a resultant current of the second current and the third current is supplied to the second heat generating element, and the resultant current in at least one of the unit periods of the second period is a current at which a timing when the second current is supplied and the timings of the maximum and the minimum of the third current overlap with each other.

Further features of the present invention will become apparent from the following description of exemplary embodiments with reference to the attached drawings.

Figure 3:
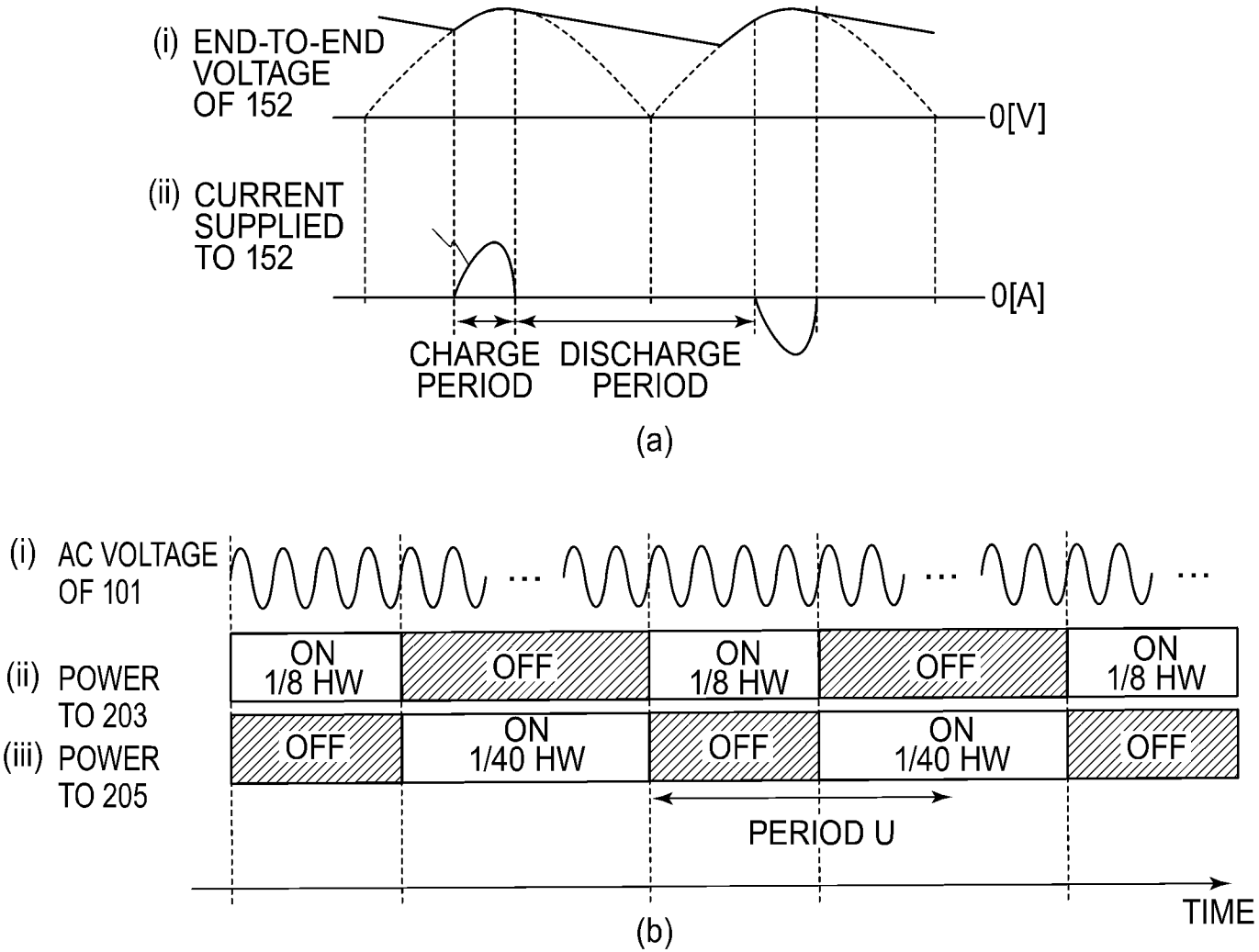

Parts (a) of FIG. 3 is a waveform diagram of a capacitor input current of the power source device in the embodiment 1, and part (b) of FIG. 3 is a schematic view for illustrating heat generating element switching control.

Figure 4:
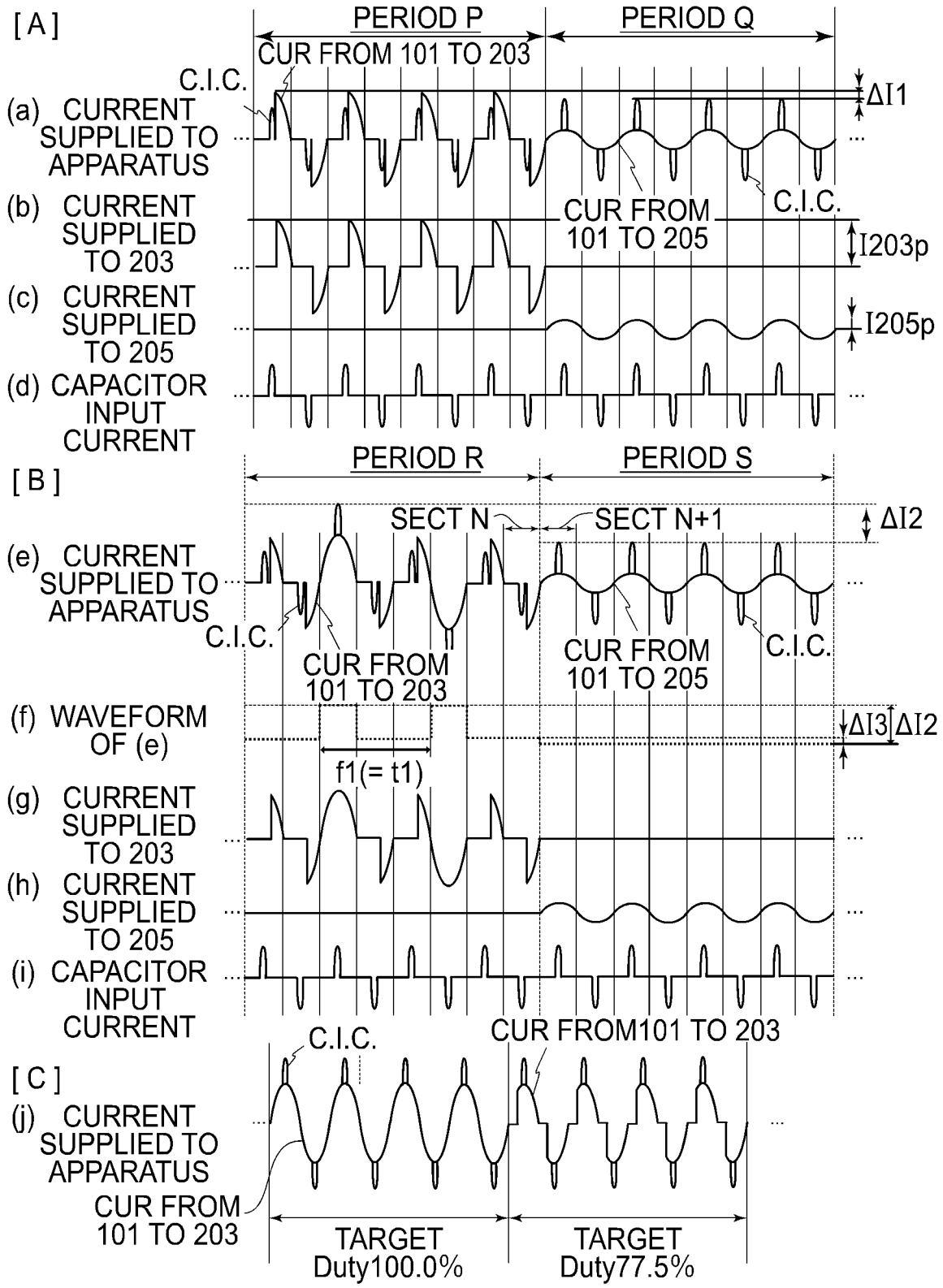

Parts [A], [B] and [C] of FIG. 4 are waveform diagrams for illustrating current waveforms of currents supplied from a commercial AC power source to the image forming apparatus of the embodiment 1.

Figure 5:
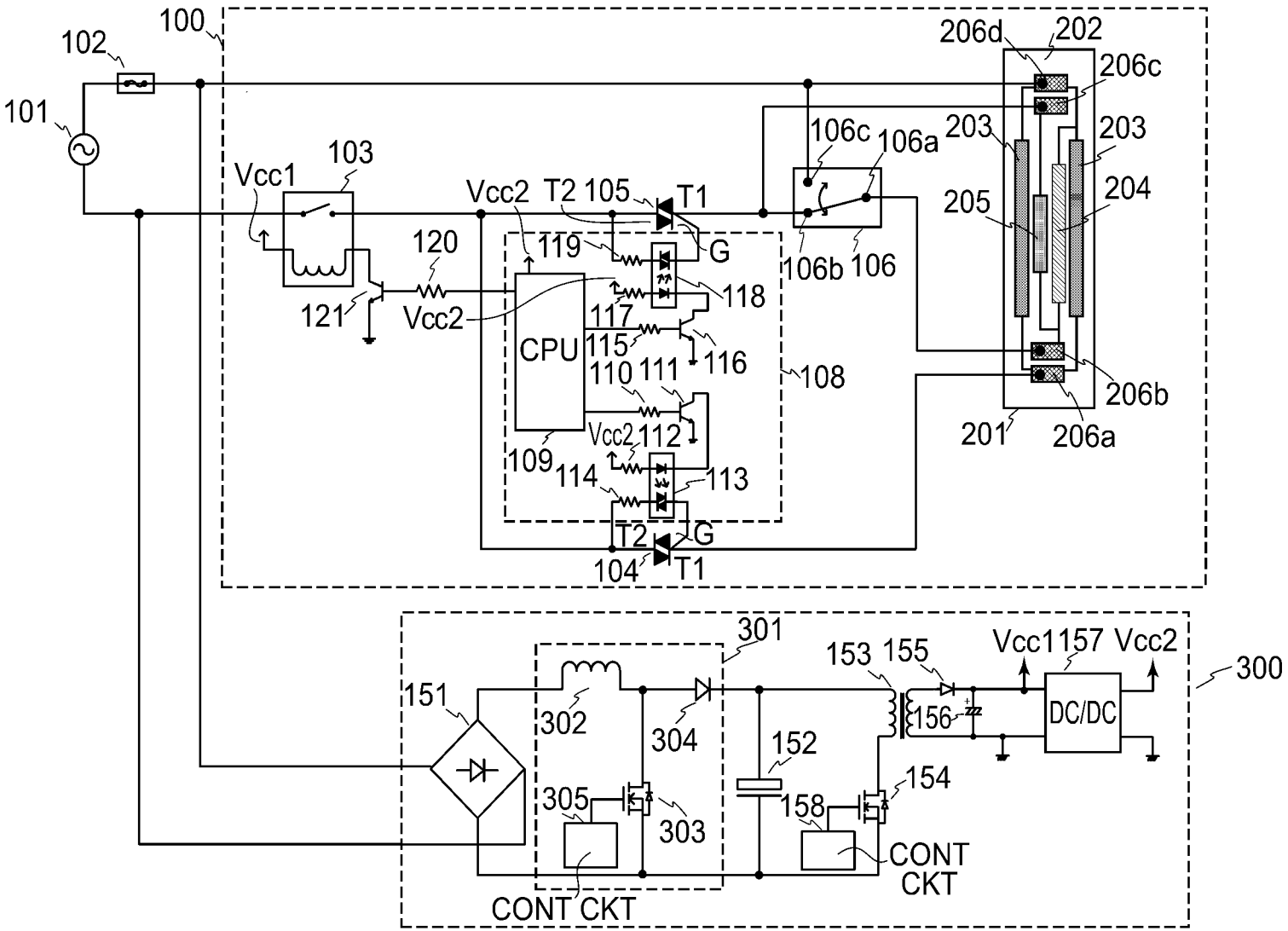

FIG. 5 is a circuit diagram showing a heating device and a power source device in the embodiment 2.

Figure 6:
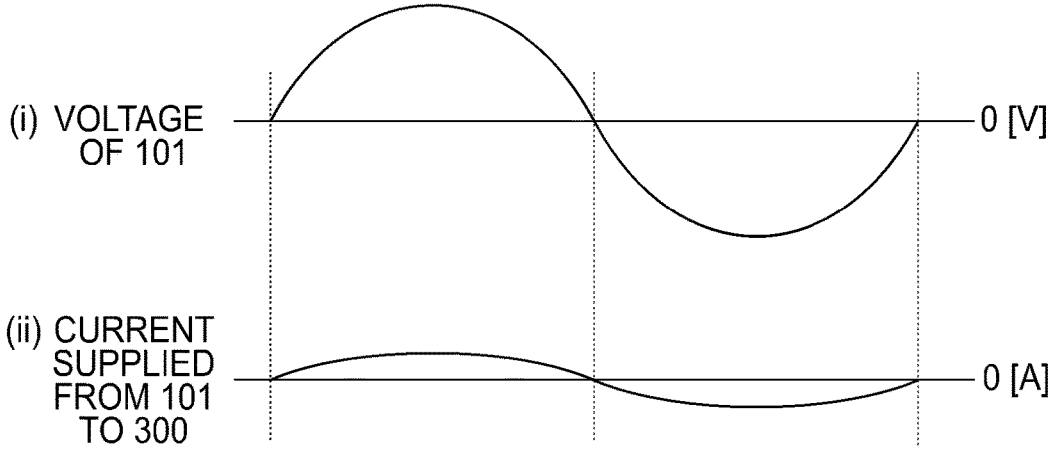
Figure 6:
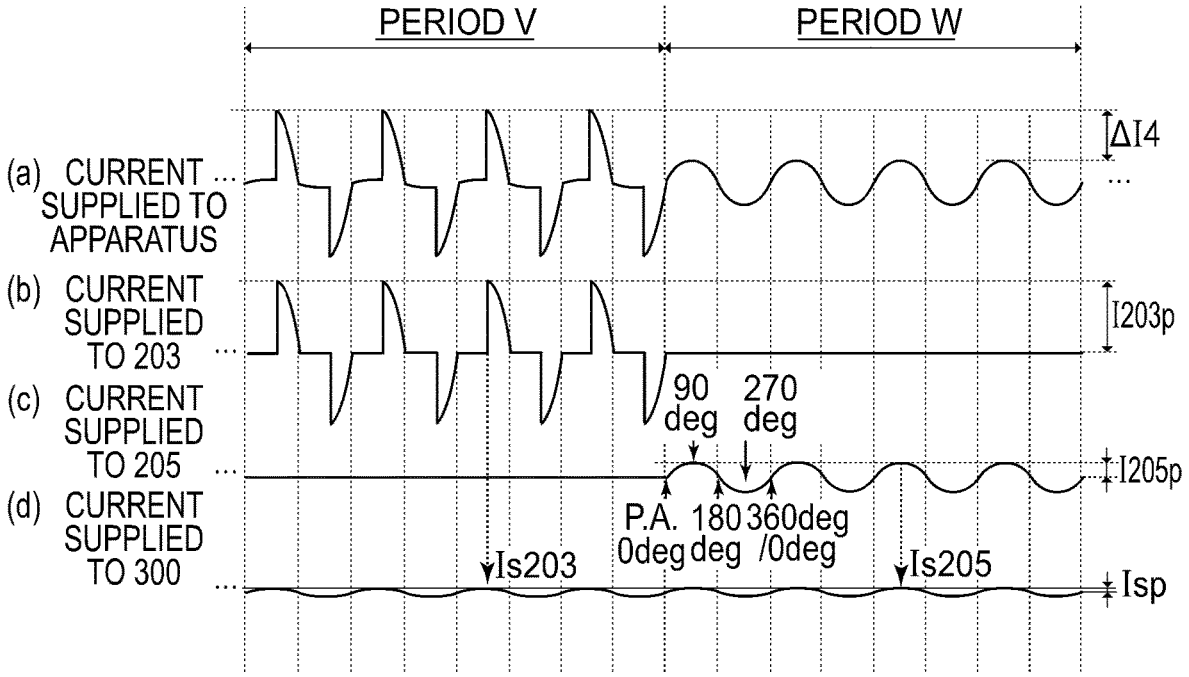

Part [A] of FIG. 6 includes waveform diagrams of an AC voltage of the commercial AC power source and an alternating current supplied from the commercial AC power source to the power source device, and part [B] of FIG. 6 includes waveform diagrams of alternating currents supplied from the commercial AC power source.

Figure 7:
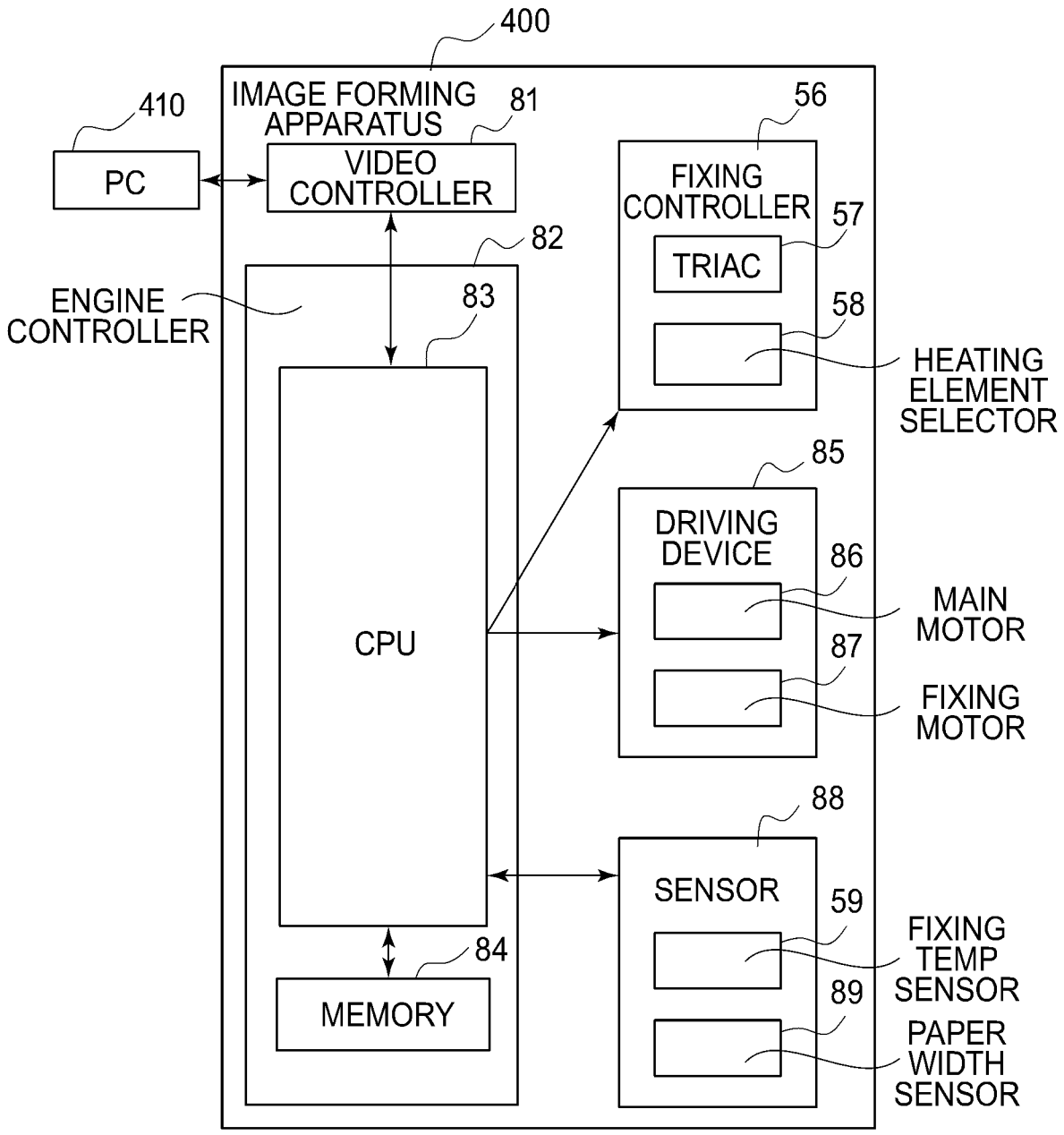

FIG. 7 is a block diagram showing a constitution of a controller of an image forming apparatus of the embodiment 3.

Figure 8:
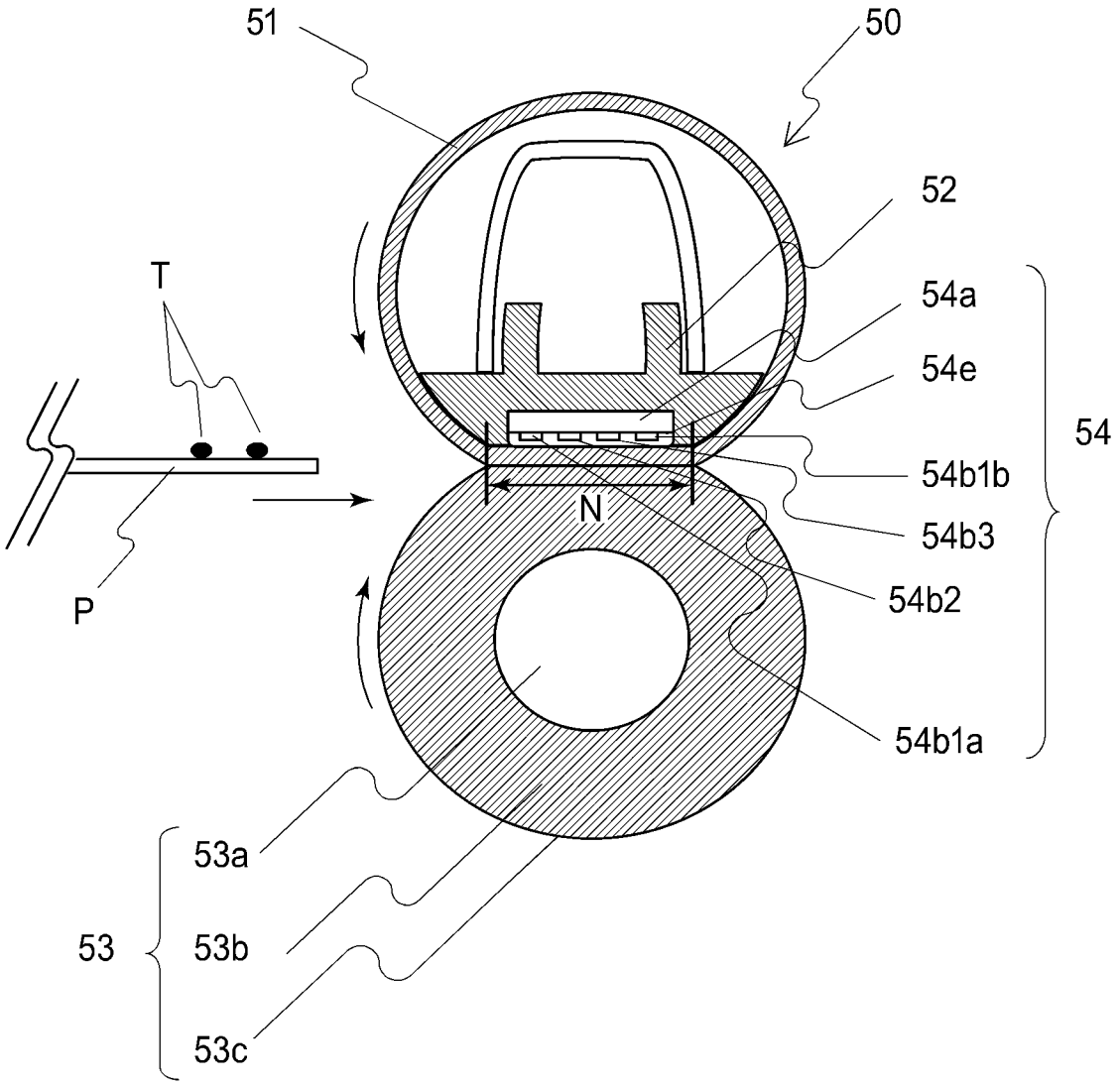

FIG. 8 is a schematic sectional view for illustrating a structure of a fixing device in the embodiment 3.

Figure 9:
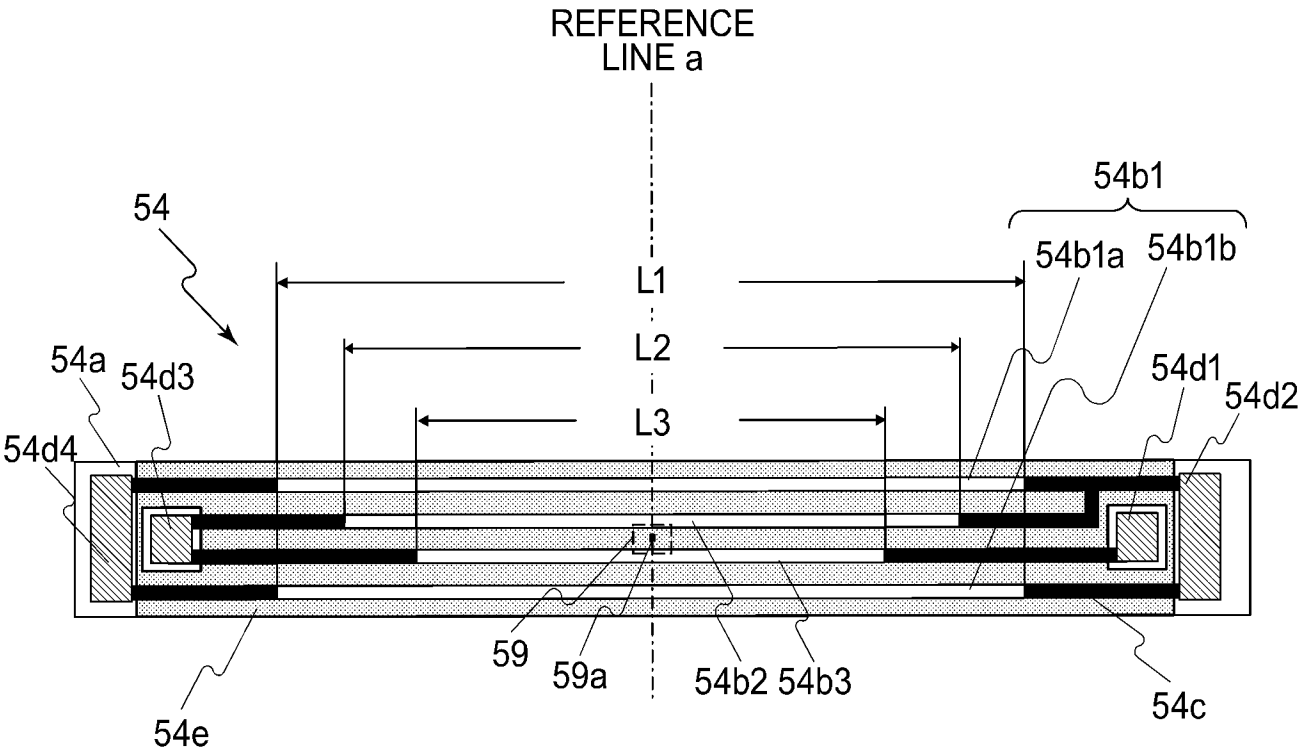

FIG. 9 is a schematic view showing a structure of a heater in the embodiment 3.

Figure 10:
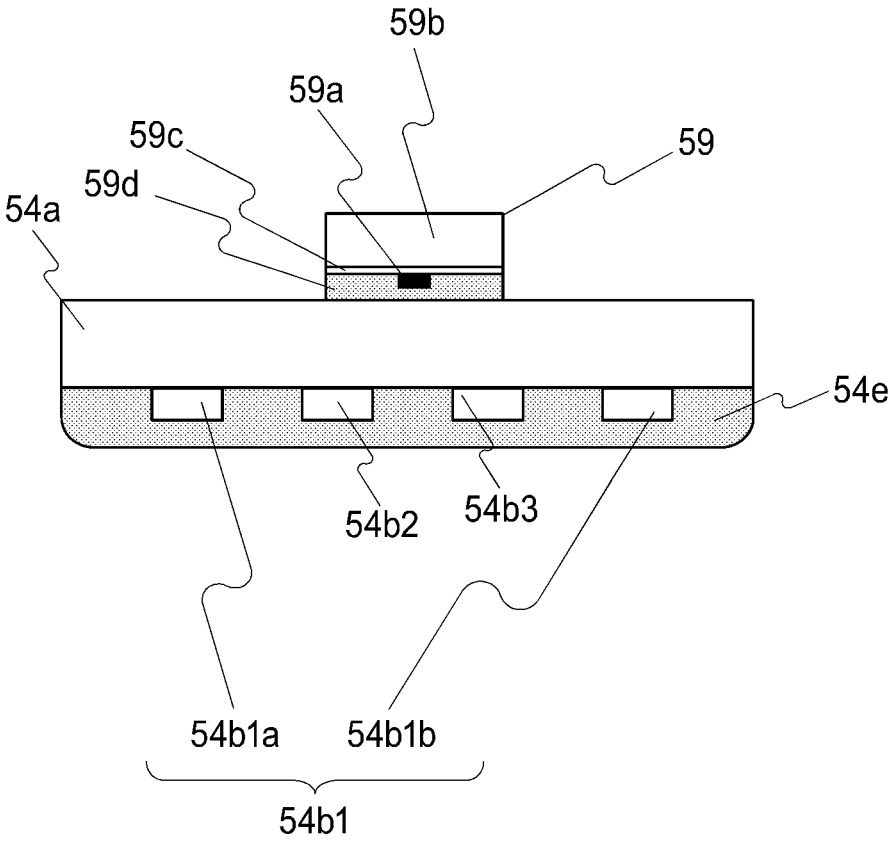

FIG. 10 is a schematic view showing a cross-section of the heater in the embodiment 3.

Figure 11:
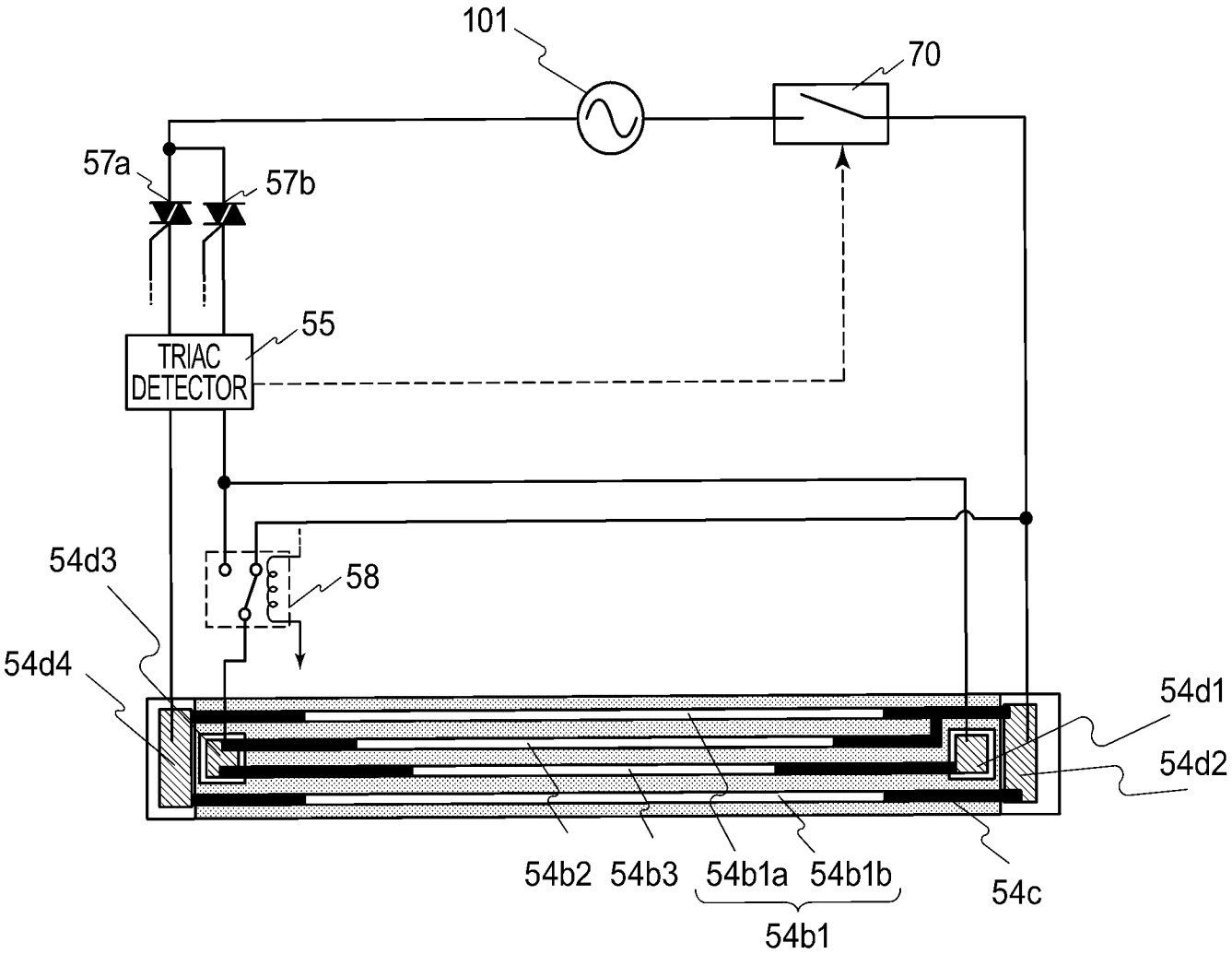

FIG. 11 is a schematic view showing a constitution of a fixing control circuit of the fixing device in the embodiment 3.

Figure 12:
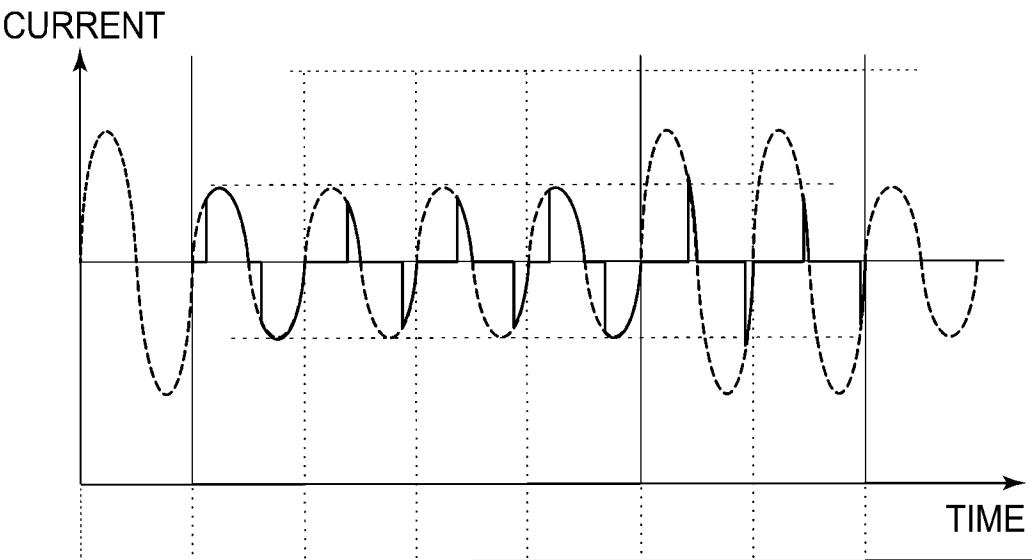

FIG. 12 is a schematic view for illustrating control of an electric power duty of heat generating elements in the embodiment 3.

Figure 13:
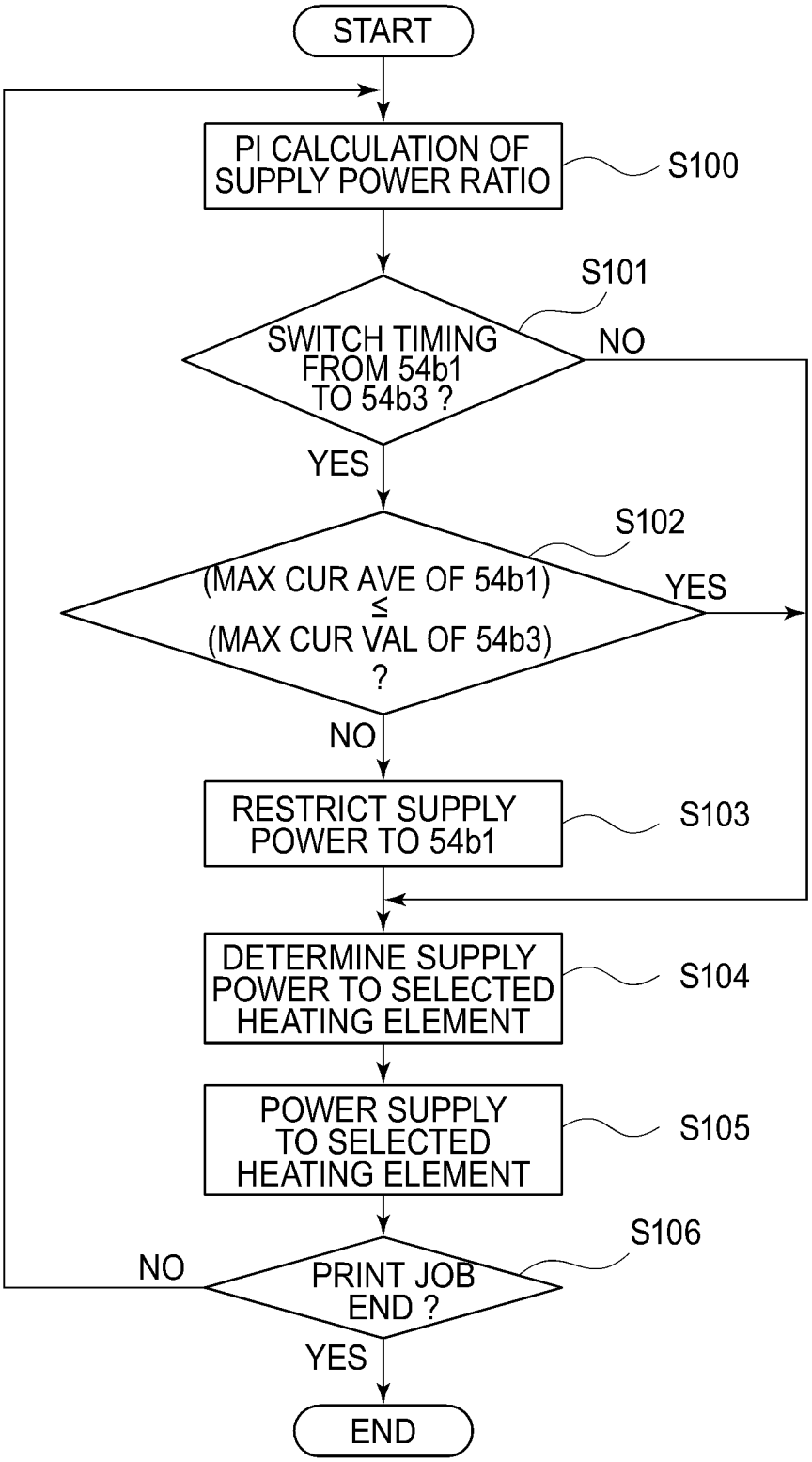

FIG. 13 is a flowchart for carrying out the control of the electric power duty of the heat generating elements in the embodiment 3.

Figure 14:
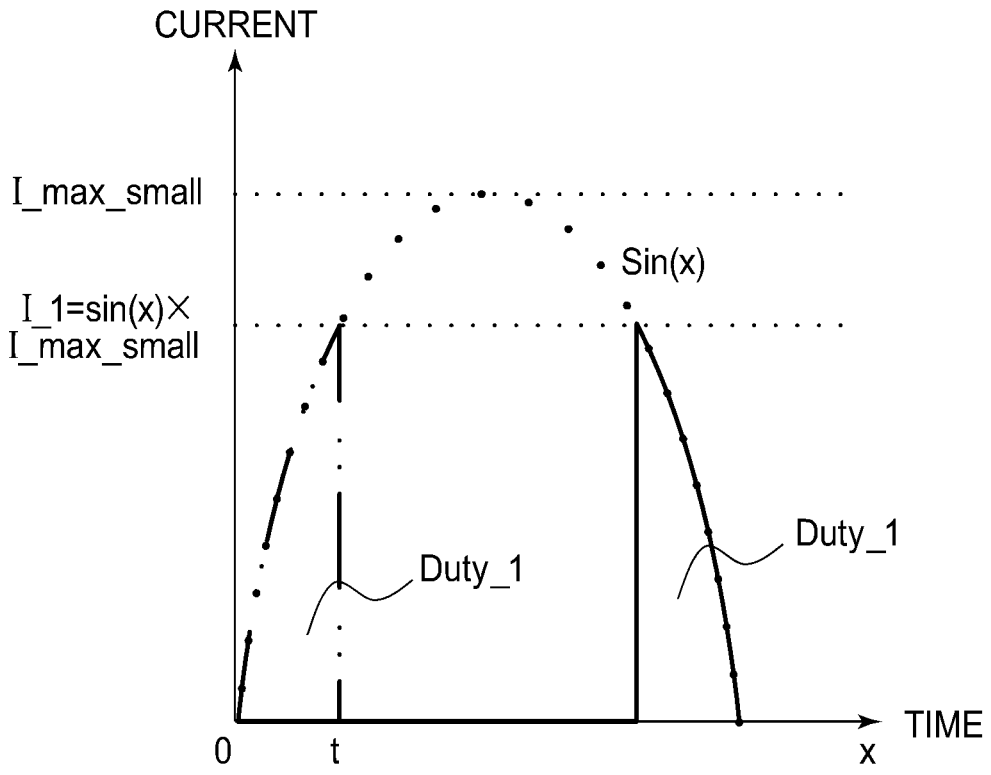

FIG. 14 is a graph for illustrating a control method of the electric power duty of the heat generating elements in the embodiment 3.

FIGS. 15, 16 and 17 are tables showing electric power supply control according to certain embodiments described herein.

DESCRIPTION OF THE DRAWINGS

In the following, embodiments of the present invention will be described specifically.

Embodiment 1

Figure 1:
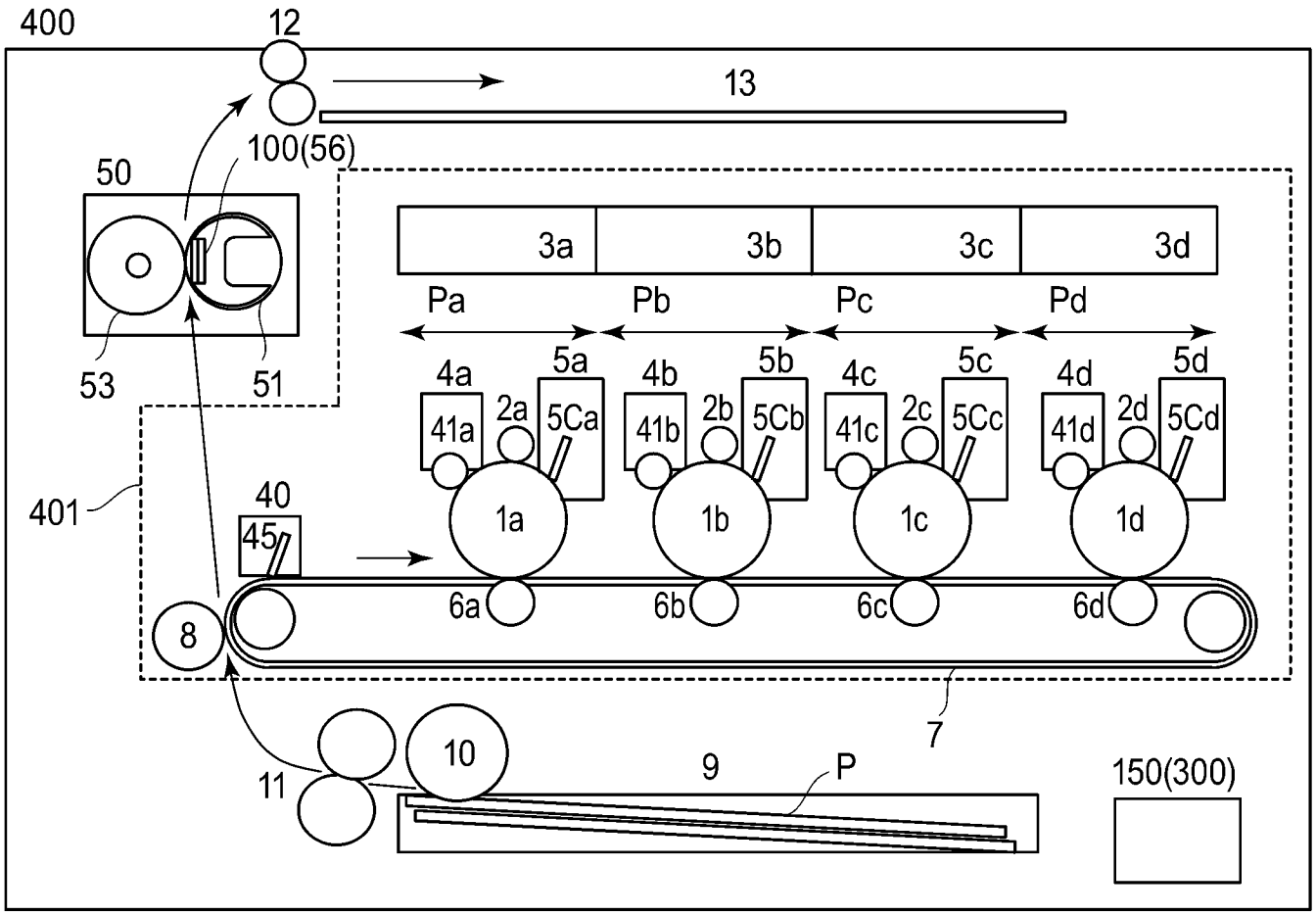
FIG. 1 is a schematic sectional view showing a structure of an image forming apparatus according to embodiments 1 to 3.

FIG. 1 is a schematic sectional view showing a structure of an image forming apparatus 400 including a fixing device 50 of an embodiment 1. In the image forming apparatus 400 shown in FIG. 1, an image forming portion 401 (indicated by a dotted line in FIG. 1) for forming toner images on a recording material P includes four image forming stations Pa, Pb, Pc and Pd for forming the toner images of yellow, magenta, cyan and black, respectively. Further, the image forming portion 401 includes laser scanners 3*a*, 3*b*, 3*c* and 3*d* provided correspondingly to the image forming stations Pa, Pb, Pc and Pd, respectively, and for forming electrostatic latent images on photosensitive drums 1*a*, 1*b*, 1*c* and 1*d*, respectively, of the image forming stations Pa, Pb, Pc and Pd. The image forming stations Pa, Pb, Pc and Pd include cylindrical photosensitive drums 1*a*, 1*b*, 1*c* and 1*d* which are image bearing members, charging rollers 2*a*, 2*b*, 2*c* and 2*d*, and developing devices 4*a*, 4*b*, 4*c* and 4*d* provided with developing rollers 41*a*, 41*b*, 41*c* and 41*d*. The image forming stations Pa, Pb, Pc and Pd have the same structure, and suffixes a, b, c and d of reference numerals or symbols of members thereof show the members for the associated image forming stations Pa, Pb, Pc and Pd, respectively. In the following, the suffixes a, b, c and d of the reference numerals or symbols will be omitted except for the case where the suffix indicates the member for a specific image forming station.

The charging roller 2 electrically charges the photosensitive drum 1 to a uniform potential. The photosensitive drum 1 charged to the uniform potential by the charging roller 2 is irradiated with laser light depending on image data by the laser scanner 3, so that an electrostatic latent image depending on the image data is formed on a surface of the photosensitive drum 1. On the electrostatic latent image formed on the surface of the photosensitive drum 1, toner is deposited by the developing roller 41 of the developing device 4, whereby a toner image is formed on the photosensitive drum 1. The resultant toner images formed on the photosensitive drums 1 are successively transferred superposedly onto an intermediary transfer belt 7, rotating in an arrow direction (clockwise direction) in FIG. 1, by primary transfer members 6 provided at positions opposing the photosensitive drums 1. Incidentally, toner remaining on the photosensitive drum 1 without being transferred onto the intermediary transfer belt 7 is removed by a cleaning blade 5C of a cleaner 5. The toner images transferred onto the intermediary transfer belt 7 are fed to a secondary transfer nip formed by contact between the intermediary transfer belt 7 and a secondary transfer roller 8 in order to transfer the toner images onto the intermediary transfer belt 7.

On the other hand, in a sheet (paper) feeding cassette 9, recording materials P are accommodated, and when an image forming operation is started, the recording materials P are fed one by one to a feeding passage by a feeding roller 10. The recording material P fed by the feeding roller 10 is conveyed to the secondary transfer nip by a conveying roller pair 11, and in the secondary transfer nip, the toner images on the intermediary transfer belt 7 are transferred onto the recording material P. Toner remaining on the intermediary transfer belt 7 without being transferred onto the recording material P is removed by an intermediary transfer belt cleaning blade 45 of an intermediary transfer belt cleaner 40.

The recording material P on which the toner images are transferred in the secondary transfer nip is conveyed to the fixing device 50 in order to fix the toner images on the recording material P. The fixing device 50 is disposed in an inner space of a cylindrical fixing film 51, and includes a heating device 100 (see FIG. 2) for heating the fixing film 51 and a pressing roller 53, forming a nip in contact with the fixing film 51, for pressing the recording material P. In the fixing device 50, the conveyed recording material P is heated and pressed when passes through the nip, so that the toner images are fixed on the recording material P. Then, the recording material P passed through the fixing device 50 is discharged onto a discharge portion 13 by a discharging roller pair 12. Further, a power source device 150 generates a DC voltage necessary inside the image forming apparatus 400 and then supplies the DC voltage to respective devices inside the image forming apparatus 400. Incidentally, a power source device 300 is a power source device used in an embodiment 2 described later. Further, a fixing control device 56 is a control device for the fixing device 50 used in an embodiment 3 described later.

[Heating Device]

Figure 2:
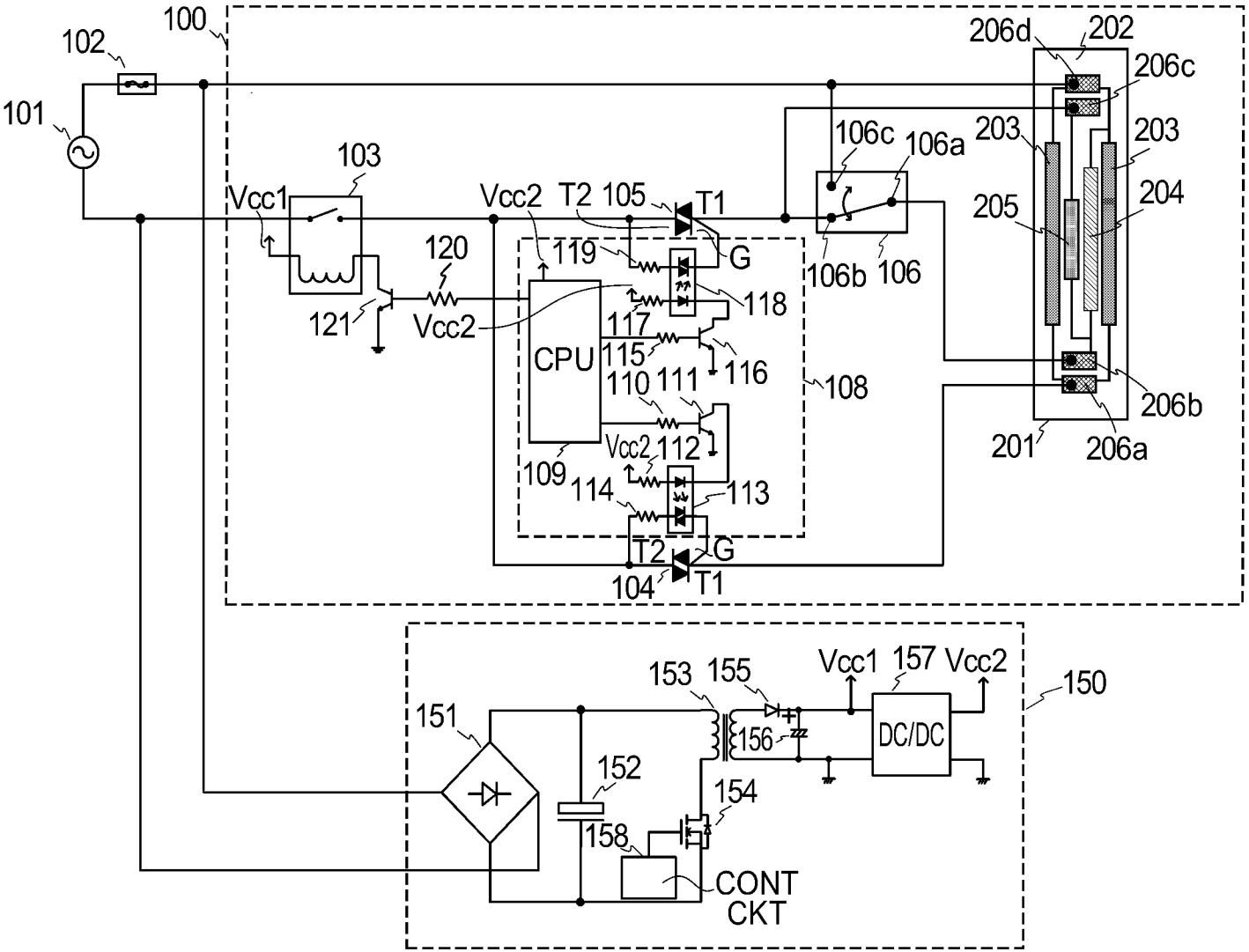
FIG. 2 is a circuit diagram showing a circuit constitution of a heating device and a power source device in the embodiment 1.

FIG. 2 is a circuit diagram showing a circuit constitution of the heating device 100 and the power source device 150 which are included in the image forming apparatus 400 of FIG. 1. As shown in FIG. 2, the heating device 100 is constituted by a heater 201 including a plurality of heat generating elements and a heater control circuit (hereinafter, referred also to as a controller) 108 for controlling electric power supply to the heater 201.

In FIG. 2, a first closed circuit through which a current from a commercial AC power source 101 for supplying an AC voltage flows is constituted by the commercial AC power source 101, a current fuse 102, the heater 201, a bidirectional thyristor (hereinafter, referred to as triac) 104, and an electromagnetic relay 103. Further, a second closed circuit through which the current from the commercial AC power source 101 flows is constituted by the commercial AC power source 101, the current fuse 102, the heater 201, an electromagnetic relay 106, the triac 105, and the electromagnetic relay 103. The electric power supply from the commercial AC power source 101 to the first closed circuit is controlled by switching a state of the triac 104 between a conduction and a non-conduction state by the controller 108. On the other hand, the electric power supply from the commercial AC power source 101 to the second closed circuit is controlled by switching the state of the triac 105 between the conduction state and the non-conduction state by the controller 108.

[Heater]

The heater 201 is disposed inside the heating device 100 provided in the fixing device 50 of the image forming apparatus 400 of this embodiment, and supplies heat applied to the toner image when the (unfixed) toner image is fixed on the recording material P by the fixing film 51. The heater 201 is constituted by a ceramic substrate 202, heat generating elements 203, 204 and 205 and (electric) contacts 206*a*, 206*b*, 206*c* and 206*d*, which are disposed on the ceramic substrate 202. The heat generating element 203 which is a constituent element of the first closed circuit is constituted by two heat generating elements connected in parallel, and is supplied with electric power from the commercial AC power source 101 via the contacts 206*a* and 206*d*.

Further, the heat generating elements 204 and 205 are constituent elements of the second closed circuit. The heat generating element 204 is supplied with the electric power from the commercial AC power source 101 via the contacts 206*b* and 206*d*. On the other hand, the heat generating element 205 is supplied with the electric power from the commercial AC power source 101 via the contacts 206*b* and 206*c*.

Whether to connect the heat generating element 204 with the second closed circuit or the heat generating element 205 with the second closed circuit, i.e., whether the electric power is supplied from the commercial AC power source 101 to the heat generating element 204 or the heat generating element 205 is selected by a C contact relay 106. In the case where contacts 106*a* and 106*b* are connected to each other in the C contact relay 106, the heat generating element 205 is put in a short-circuited state by the C contact relay 106, and therefore, a state in which the heat generating element 204 is selected as the constituent element of the second closed circuit is formed. As a result, the electric power is supplied from the commercial AC power source 101 to the heat generating element 204. on the other hand, in the case where the contact 106*a* and a contact 106*c* are connected to each other in the C contact relay 106, the heat generating element 204 is put in a short-circuited state by the C contact relay 106, and therefore, a state in which the heat generating element 205 is selected as the constituent element of the second closed circuit is formed. As a result, the electric power is supplied from the commercial AC power source 101 to the heat generating element 205. Thus, as the constituent element of the second closed circuit, the heat generating element 204 or the heat generating element 205 is appropriately selected by controlling the C contact relay 206.

Incidentally, a magnitude relationship resistance values of the heat generating elements 203, 204 and 205 are such that (resistance value of heat generating element 203)<(resistance value of heat generating element 204)<(resistance value of heat generating element 205) holds. In this embodiment, the resistance values of the heat generating elements 204 and 205 are 1.92 times and 2.25 times the resistance value of the heat generating element 203, respectively.

[Heater Control Circuit]

The heater contact circuit (controller) 208 includes a CPU 109, solid state relays (SSRs) 113 and 118, transistors 111 and 116, resistors 110, 112, 114, 115, 117 and 119. The triac 104 is controlled by the CPU 109 of the controller 108. In the case where the CPU 109 sets a state of the triac 104 between a T1 terminal and a T2 terminal thereof at the conduction state, the CPU 109 supplies the current to a base terminal of the transistor 111 via a current-limiting resistor 110. By this, the transistor 111 is turned on, so that a state of the transistor 111 between a collector terminal and an emitter terminal is put in the conduction state. When the state of the transistor 111 between the collector terminal and the emitter terminal is put in the conduction state, the current flows from a power source voltage Vcc2 to a light emitting diode of the SSR 113 via a current-limiting resistor 112, so that a light emission state is formed. As a result, a light receiving portion of the SSR 113 is put in an ON state (conduction state), a gate current flows from the commercial AC power source 101 to a G (gate) terminal of the triac 104 via a current-limiting resistor 114, so that the state of the triac 104 between the T1 terminal and T2 terminal is put in the conduction state. Here, the power source voltage Vcc2 is a DC voltage with a secondary-side potential, such as DC 3.3 V (potential) electrically isolated from the commercial AC power source 101), and is generated by the power source device 150 described later.

On the other hand, the triac 105 is also collected by the CPU 109 similarly as the triac 104. In the case where the CPU 109 sets a state of the triac 105 between a T1 terminal and a T2 terminal thereof at the conduction state, the CPU 109 supplies the current to a base terminal of the transistor 116 via a current-limiting resistor 115. By this, the transistor 116 is turned on, so that a state of the transistor 116 between a collector terminal and an emitter terminal is put in the conduction state. When the state of the transistor 116 between the collector terminal and the emitter terminal is put in the conduction state, the current flows from a power source voltage Vcc2 to a light emitting diode of the SSR 118 via a current-limiting resistor 117, so that a light emission state is formed, so that a light receiving portion of the SSR 118 is put in an ON state (conduction state), with the result that a gate current flows from the commercial AC power source 101 to a G (gate) terminal of the triac 105 via a current-limiting resistor 119, so that the state of the triac 105 between the T1 terminal and T2 terminal is put in the conduction state. Incidentally, the CPU 109 controls the conduction state and the non-conduction state of each of the triacs 104 and 105 on the basis of an electric power supply control table (table 1) appearing hereinafter.

Here, in the image forming apparatus 400 of this embodiment exclusively controls the conduction state of the triac 104 and the conduction state of the triac 105 so as not to simultaneously supply the electric power from the commercial AC power source 101 to the first closed circuit and the second closed circuit. Specifically, in the case where the state of the triac 104 between the T1 terminal and the T2 terminal is the conduction state, the controller 108 sets the state of the triac 105 between the T1 terminal and the T2 terminal at the non-conduction state. On the other hand, in the case where the state of the triac 105 between the T1 terminal and the T2 terminal is the conduction state, the controller 108 sets the state of the triac 104 between the T1 terminal and the T2 terminal at the non-conduction state.

This is because in order to uniformize a thermal distribution of the heater 201 with respect to a longitudinal direction (widthwise direction of the recording material P substantially perpendicular to a direction in which the recording material P is fed to the fixing device 50), the three kinds of the heat generating elements are exclusively selected depending on a sheet width of the recording material P used. For example, in the case where the B5-size recording material P passes through the nip of the fixing device 50, the controller 108 alternately supplies the electric power to the heat generating elements 203 and 204 and causes the heat generating elements 203 and 204 to generate heat. The reason why such electric power supply control is carried out is that design of the heater 201 is made on the assumption that the electric power is exclusively supplied to the respective heat generating elements, and therefore, when a state in which the plurality of heat generating elements generate heat at the same time is continued, there is a liability that the heater 201 overheats and breaks.

The state of the electromagnetic relay 103 is set at the non-conduction state for saving energy when there is no need to supply the electric power to the heater 201 (for example, in the case where the image forming apparatus 400 is in a sleep mode in which an electric power saving state that printing is not performed is formed, or in the like case). The electromagnetic relay 103 is controlled by the CPU 109 similarly as the triacs 104 and 105. The CPU 109 turns on the transistor 121 by supplying the current to the base terminal of the transistor 121 via the current-limiting resistor 120, so that the state of the transistor 121 between the collector terminal and the emitter terminal is put in the conduction state. By this, the current flows from a power source voltage Vcc1 to a coil of the electromagnetic relay 103, whereby the state of the contacts of the electromagnetic relay 103 are set at the conduction state.

[Power Source Device]

Next, the power source device 150 will be described. The power source device 150 is a switching converter of an AC input/DC output type in which a DC voltage (for example, 24 V, 12 V, 5 V, 3.3 V, or the like) necessary in the image forming apparatus 400 is generated from an AC voltage outputted from the commercial AC power source 101. The power source device 150 includes a diode bridge 151, a primary smoothing capacitor 152, a transformer 153, a field-effect transistor (FET) 154, and a control circuit 158 for controlling a switching operation of the FET 154. Further, the power source device 150 includes a rectifying diode 155, a secondary smoothing capacitor 156, and a DC/DC converter 157.

In the power source device 150, the diode bridge 151 which is a rectifying circuit subjects the AC voltage inputted from the commercial AC power source 101 to full-wave rectification, and the voltage subjected to the full-wave rectification is smoothed by the primary smoothing capacitor 152 which is a smoothing circuit. The voltage smoothed by the primary smoothing capacitor 152 is inputted to a primary side of the transformer 153, and a voltage is induced on a secondary side of the transformer by the switching operation of the FET 154. The voltage induced on the secondary side of the transformer 153 is rectified and smoothed by the rectifying diode 155 and the secondary smoothing capacitor 156, and the like, so that a DC voltage Vcc1 (24 V in this embodiment). The DC voltage Vcc1 is further converted into a DC voltage Vcc2 (3.3 V in this embodiment) through the DC/DC converter 157. Incidentally, the power source device 150 is not a feature of the present invention, and therefore, details of a circuit operation will be omitted from description.

Part (a) of FIG. 3 includes waveform diagrams showing a voltage waveform (FIG. 3(*a*) (i)) of an end-to-end voltage of the primary smoothing capacitor 152 and a voltage waveform (FIG. 3(*a*) (ii)) of a current flowing through the primary smoothing capacitor 152. In (i) of part (a) of FIG. 3, the ordinate represents the voltage, and in (ii) of part (a) of FIG. 3, the ordinate represents the current. In (i) and (ii) of part (a) of FIG. 3, the abscissa represents a time.

In (i) of part (a) of FIG. 3, a bold solid line represents the voltage waveform of the end-to-end voltage of the primary smoothing capacitor 152, and a broken line represents a voltage obtained by subjecting the AC voltage, inputted from the commercial AC power source 101, to the full-wave rectification by the diode bridge 151. In (ii) of part (a) of FIG. 3, a hold solid line represents a current waveform of the current supplied (outputted) from the commercial AC power source 101 to the primary smoothing capacitor 152. Here, the current (capacitor input current) flowing through the primary smoothing capacitor 152 shown in (ii) of part (a) of FIG. 3 flows only in the following period. That is, the capacitor input current flows only in a period (charge period shown in (ii) of part (a) of FIG. 3) in which the voltage of the commercial AC power source 101 is lower than the voltage subjected to the full-wave rectification. On the other hand, the capacitor input current does not flow in a period (discharge period shown in (ii) of part (a) of FIG. 3) in which the voltage of the commercial AC power source 101 is higher than the voltage subjected to the full-wave rectification. Thus, the capacitor input current has a feature such that the capacitor input current flows only in a part of a period of a half cycle (half-wave) of the voltage waveform of the AC voltage outputted from the commercial AC power source 101.

[Electric Power Supply to Heat Generating Element]

An operation of the heating device 100 in the case where the image is formed on the recording material P will be described using an A5-size recording material P as an example. In the case where the image is formed on the A5-size recording material P, the C contact relay 106 (FIG. 2) in the heating device 100 is in a state in which the contacts 106*a* and 106*b* are connected to each other, so that a state in which the heat generating element 205 is selected as the constituent element of the second closed circuit is formed. Further, the heating device 100 is operated so that a temperature of the heater 201 is controlled to a predetermined temperature.

Specifically, in the heating device 400, on the basis of the temperature of the heater 201 detected by a temperature detecting element (not shown), PID control for a target temperature of the heater 201 is carried out, so that temperature control (temperature adjustment) of the heater 201 is carried out. The temperature control (temperature adjustment) of the heater 201 is performed commonly irrespective of the size of the recording material P on which the image is to be formed. On the basis of the PID control, current values of currents supplied to the first closed circuit which is an energizing circuit to the heat generating element 203 and the second closed circuit which is an energizing circuit to the heat generating element 205 follow electric power supply control tables shown as tables 1 and 2 appearing hereinafter.

[Electric Power Supply Control Table]

The table 1 (depicted in FIG. 15) is the electric power supply control table in the case where the electric power is supplied to the heat generating element 203, and the table 2 (depicted in FIG. 16) is the electric power supply control table in the case where the electric power is supplied to the heat generating elements 204 and 205.

The electric power supply control of the electric power supplied to the heat generating element 203 on the basis of the electric power supply control table shown as the table 1 is carried out as shown at an upper portion of the table 1 in a manner such that 8 half-waves (4 cycles) of the alternating voltage in which of the commercial AC power source 101 is used as one control cycle. On the other hand, numerical values shown at a lower portion of the table 1 show electric power duties (unit: %), of electric power supplied to the heat generating element 203 in a period of each half-wave, with respect to an average target input electric power duty in one control cycle. In this embodiment, the electric power supply control is carried out by dividing the electric power duty ("Electric Power Duty" in the table 1), of the electric power capable of being supplied from the commercial AC power source 101 to the heat generating element 203, into 40 stages (levels) with an increment of 2.50%. That is, a gain updating cycle of the above-described PID is 8 half-wave unit of the alternating voltage waveform of the commercial AC power source 101, and the table 1 shows that what % of the electric power capable of being supplied from the commercial AC power source 101 to the heat generating element 203 is supplied to the heat generating element 203 by the above-described PID. For example, in the case where the electric power of 50.00% in electric power duty is supplied from the commercial AC power source 101 to the heat generating element 203 in terms of a total of 8 half-waves, the electric power supply is controlled in the following manner on the basis of the table 1. That is, the electric power supply is controlled so that the electric power is supplied in a manner such that the electric power duty for a first half-wave is 33.75%, the electric power duty for a second half-wave is 33.75%, the electric power duty for a third half-wave is 100.00%, the electric power duty for a fourth half-wave is 33.75%, the electric power duty for a fifth half-wave is 33.75%, the electric power duty for a sixth half-wave is 100.00%, the electric power duty for a seventh half-wave is 33.75%, and the electric power duty for an eighth half-wave is 33.75%. Incidentally, thus, as shown in the table 1, an average input electric power duty in the case of the electric power supply for the 8 half-waves is 50.31%, which is not strictly 50.00%, but the electric power duty of 50.00% is only a target value, and thus such a minute difference falls within a range of an error.

Further, the electric power supply control of the electric power supplied to the heat generating element 205 is carried out on the basis of an electric power supply control table shown as the table 2. The table 2 is the same as the table 1 in terms of the control cycle, a control resolution, and the like except that numerical values electric power duties (unit: %), of the electric power supplied to the heat generating element 205 in a period of each half-wave, with respect to the average target input electric power duty in one control cycle in the table 2 are different from those in the table 1.

In the case where the image is formed on the A5-size recording material P, on the basis of a control sequence determined in advance, a period in which the electric power is supplied to the heat generating element 203 through the first closed circuit and a period in which the electric power is supplied to the heat generating element 205 through the second closed circuit are exclusively switched to each other. Part (b) of FIG. 3 includes an alternating voltage waveform of the commercial AC power source 101 and schematic views for illustrating a relationship between periods in which the electric power is supplied to the heat generating element 203 and the heat generating element 205, respectively. In part (b) of FIG. 3, (i) shows the alternating voltage waveform of the AC voltage supplied from the commercial AC power source 101 to the image forming apparatus 400, (ii) is the schematic view showing periods (indicated as "ON" in the figure) in which the electric power is supplied to the heat generating element 203 and periods (indicates as "OFF" in the figure) in which the electric power is not supplied to the heat generating element 203, and (ii) is the schematic view showing periods (indicated as "ON" in the figure) in which the electric power is supplied to the heat generating element 205 and periods (indicated as "OFF" in the figure) in which the electric power is not supplied to the heat generating element 205. In part (b) of FIG. 3, the abscissa represents a time. As shown in part (b) of FIG. 3, the electric power is supplied to the heat generating element 203 through the first closed circuit in a period of one control cycle (=8 half-waves) and then is supplied to the heat generating element 205 through the second closed circuit in a period of 5 control cycles (=40 half-waves). Thereafter, the electric power is supplied to the heat generating element through the first closed circuit in a period of one control cycle (=8 half-waves) and then is supplied to the heat generating element 205 through the second control in a period of 5 control cycles (=40 half-waves). This cycle of the electric power supply is repeated. Thus, in the heating peak value 100, the temperature adjustment of the heater 210 is performed while switching the electric power supply to the heat generating element. Incidentally, detailed description as to the tables 1 and 2 will be described later.

[Waveform of Current Inputted from Commercial AC Power Source to Image Forming Apparatus]

A period U shown in part (b) of FIG. 3 shows a period of one control cycle (=8 half-waves) in which the electric power is supplied to the heat generating element 203 via the first closed circuit and a period of one control cycle (=8 half-waves) in which the electric power is supplied to the heat generating element 205 via the second closed circuit. Parts [A] to [C] of FIG. 4 are waveform diagrams for illustrating current waveforms of alternating currents (ACs) supplied from the commercial AC power source 101 to the image forming apparatus.

Part [A] of FIG. 4 includes the waveform diagrams showing the current waveforms of the alternating currents when the electric power is supplied to the heat generating element 203 in a period P and the current waveforms of the alternating currents when the electric power is supplied to the heat generating element 205 in a period Q continuous to the period P. In part [A] of FIG. 4, the abscissa represents a time. The period P is one control cycle (first period) including 8 half-waves in which the electric power is supplied to the heat generating element 203 via the first closed circuit and in which the average target input electric power duty is 42.50%. On the other hand, the period Q is one control cycle (second period) including 8 half-waves in which the electric power is supplied to the heat generating element 205 via the second closed circuit and in which the average target input electric power duty is 100%.

In part [A] of FIG. 4, (b) shows the current waveform of the AC (first current) when the electric power with the average target input electric power duty of 42.50% is supplied from the commercial AC power source 101 to the heat generating element 203. In the case where the average target input electric power duty is 42.50%, the current supplied from the commercial AC power source 101 to the heat generating element 203 has a waveform such that on the basis of the electric power control table which is the table 1, the current is always subjected to phase control with the duty of 42.50% through entirety of one control cycle of 8 half-waves.

In part [A] of FIG. 4, (c) shows the current waveform of the AC (second current) when the electric power with the average target input electric power duty of 100.00% is supplied from the commercial AC power source 101 to the heat generating element 205. In the case where the average target input electric power duty is 100.00%, the current supplied from the commercial AC power source 101 to the heat generating element 205 has a current waveform such that on the basis of the electric power control table which is the table 2, the duty is always 100.00% through entirety of one control cycle of 8 half-waves.

Incidentally, as described above, the resistance value of the heat generating element 205 is 2.25 times the resistance value of the heat generating element 203. For that reason, an electric power amount when the electric power duty of the electric power supplied from the commercial AC power source to the heat generating element 203 is 42.50% and an electric power amount when the electric power duty of the electric power supplied from the commercial AC power source to the heat generating element 205 is 100.00% are substantially equal to each other.

In part [A] of FIG. 4, (d) shows the current waveform a capacitor input current (third current) (part (a) of FIG. 3) flowing when the primary smoothing capacitor 152 in the power source device 150 is charged by the commercial AC power source 101. In part [A] of FIG. 4, (a) shows a resultant waveform of three ACs shown in (b), (c) and (d) of part [A] of FIG. 4.

In the period P (period in which the electric power is supplied from the commercial AC power source 101 to the heat generating element 203), both the current supplied to the heat generating element 203 and the capacitor input current are supplied from the commercial AC power source 101, and therefore, the current waveform such that these two ACs are combined is obtained. On the other hand, in the period Q (period in which the electric power is supplied from the commercial AC power source 101 to the heat generating element 205), both the current supplied to the heat generating element 205 and the capacitor input current are supplied from the commercial AC power source 101, and therefore, the current waveform such that these two currents are combined is obtained. In the period P, the current waveform when the AC flows through the heat generating element 203 and the current waveform when the capacitor input current flows do not overlap with each other. throughout. For that reason, in the period P, a value (maximum value) of a local maximum point and a value (minimum value) of a local minimum point (hereinafter, these values are referred to as current peak values or peak values) of a resultant current of the AC flowing through the heat generating element 203 and the capacitor input current are suppressed to levels lower than those in the case where the two contact waveforms overlap with each other.

On the other hand, in the period Q, the current waveform when the AC flows through the heat generating element 205 and the current waveform when the capacitor input current flows overlap with each other throughout. For that reason, in the period Q, peak values of a resultant current of the current flowing through the heat generating element 205 and the capacitor input current are larger than those in the case where the two current waveforms do not overlap with each other. As a result, a difference ΔI1 (FIG. 4[A] (a)) indicating a difference between the current peak value in the period P and the current peak value in the period Q in the resultant current shown in (a) of part [A] of FIG. 4 is as follows. That is, the difference ΔI1 can be made smaller than a difference between a peak value I203p (FIG. 4[A] (b)) of the AC flowing through the heat generating element 203 and a peak value (205*p* (FIG. 4[A] (c)) of the AC flowing through the heat generating element 205. That is, (difference ΔI1)< ((peak value I203p)−(peak value I205p)) holds. When a value of the difference ΔI1 is small, a degree of the flicker when the image forming apparatus 400 is operated can be suppressed. For that reason, in the case where the period (period P) in which the electric power is supplied to the heat generating element 203 and the period (period Q) in which the electric power is supplied to the heat generating element 205 are exclusively switched from each other at a high frequency, control is carried out so that the capacitor input current and the AC flowing through each of the heat generating elements (heat generating elements 203 and 205). That is, in order to suppress the flicker, it is important that the difference ΔI1 indicating the difference between the current peak value in the period P and the current peak value in the period Q is made small. From another viewpoint, the resistance value of the heat generating element 205 is 2.25 times the resistance value of the heat generating element 203, so that a difference in resistance value therebetween is light, and therefore, it is difficult that the difference ΔI1 is mode small only by the current waveforms of the ACs flowing through the heat generating elements 203 and 205. Therefore, in this embodiment, instead of decreasing the difference between the current peak values only by paying attention to the ACs flowing through the heat generating elements 203 and 204, attention is paid to a resultant waveform of the capacitor input current and the AC flowing through each of the heat generating elements 203 and 205. Then, by satisfactorily controlling overlapping between composite currents, the difference ΔI1 between the peak values of the AC is suppressed to a low level. This is one of features of the present invention.

Part [B] of FIG. 4 includes the waveform diagrams showing the current waveforms of the alternating currents when the electric power is supplied to the heat generating element 203 in a period R and the current waveforms of the alternating currents when the electric power is supplied to the heat generating element 205 in a period S continuous to the period R. In part [B] of FIG. 4, the abscissa represents a time. The period R is one control cycle including 8 half-waves in which the electric power is supplied to the heat generating element 203 via the first closed circuit and in which the average target input electric power duty is 57.50%. On the other hand, the period S is one control cycle including 8 half-waves in which the electric power is supplied to the heat generating element 205 via the second closed circuit and in which the average target input electric power duty is 100%.

In part [B] of FIG. 4, (q) shows the current waveform of the AC when the electric power with the average target input electric power duty of 57.50% is supplied from the commercial AC power source 101 to the heat generating element 203. In the case where the average target input electric power duty is 57.50%, the current supplied from the commercial AC power source 101 to the heat generating element 203 is controlled on the basis of the electric power control table which is the table 1. Specifically, as shown in the case where the average target input electric power duty is 57.50%, in one control cycle, the electric power supply is controlled so that the electric power duty for a first half-waves 43.75%, the electric power duty for a second half-wave is 43.75%, the electric power duty for a third half-wave is 100.00%, the electric power duty for a fourth half-wave is 33.75%, the electric power duty for a fifth half-wave is 43.75%, the electric power duty for a sixth half-wave is 100.00%, the electric power duty for a seventh half-wave is 43.75%, and the electric power duty for an eighth half-wave is 43.75% and the electric power duty for an eighth half-wave is 43.75%.

In part [B] of FIG. 4, (h) shows the current waveform of the AC when the electric power with the average target input electric power duty of 100.00% is supplied from the commercial AC power source 101 to the heat generating element 205. In the case where the average target input electric power duty is 100.00%, the current supplied from the commercial AC power source 101 to the heat generating element 205 has a current waveform such that on the basis of the electric power control table which is the table 2, the duty is always 100.00% through entirety of one control cycle of 8 half-waves.

In part [B] of FIG. 4, (i) shows the current waveform a capacitor input current) (FIG. 3(*a*) (ii)) flowing when the primary smoothing capacitor 152 in the power source device 150 is charged by the commercial AC power source 101. In part [B] of FIG. 4, (e) shows a resultant waveform of three ACs shown in (g), (h) and (i) of part [B] of FIG. 4. In the period P (period in which the electric power is supplied from the commercial AC power source 101 to the heat generating element 203), both the current supplied to the heat generating element 203 and the capacitor input current are supplied from the commercial AC power source 101, and therefore, the current waveform such that these two ACs are combined is obtained. On the other hand, in the period S (period in which the electric power is supplied from the commercial AC power source 101 to the heat generating element 203), both the current supplied to the heat generating element 205 and the capacitor input current are supplied from the commercial AC power source 101, and therefore, the current waveform such that these two currents are combined is obtained.

In the period R, both a section in which the current peak value of the AC flowing through the heat generating element 203 and the current peak value of the capacitor input current overlap with each other and a section in which these current peak values do not overlap with each other exist. In the period R, the average target input electric power duty over the entire period is 57.50%, and therefore, when phase control is carried out at the same phase angle over the entire period, in all the half-waves, overlapping between the current waveform of the AC flowing through the heat generating element 203 and the current waveform of the capacitor input current occurs. That is, when the phase control is carried out at the same phase angle over the entire period R, a difference 412 (FIG. 4[B](e)) between the current peak value in the period R and the current peak value in the relationship S becomes light, and therefore, the flicker cannot be suppressed. For that reason, in the period R, suppression of the flicker is realized by modulating a degree of the overlapping between the current waveform of the AC supplied to the heat generating element 203 and the current waveform of the capacitor input current.

In part [B] of FIG. 4, (f) represents the current waveform in which an absolute value of a difference between peak values of the current waveform shown in (e) of part [B] of FIG. 4 is plotted every half-wave. In the period R, in a relationship between the AC flowing through the heat generating element 203 and the capacitor input current, an entire section is divided into two kinds of sections consisting of the section in which the two current peak values overlap with each other and the section in which to two current peak values do not overlap with each other, and these two kinds of the sections are not disposed locally (consecutively) but are disposed sparsely. For that reason, compared with the case where these overlapping period and non-overlapping periods are disposed locally, a fluctuation frequency f1 (current fluctuation cycle t1) of the current peaks in the period R can be made high. As regards the flicker, a user feels most uncomfortable in the case where the frequency of the current fluctuation is 8.8 Hz (cycle: 113.6 msec), and therefore, when the current fluctuation occurs, it is desirable that the current fluctuation frequency is made apart from the frequency of 8.8 Hz. For example, in the case where a power source frequency of the commercial AC power source 101 is 50 Hz, one half-wave is 10 msec (milliseconds), and therefore, a current fluctuation frequency f1 shown in (f) of part [B] of FIG. 4 is 33.3 Hz (cycle: 30 msec). In this case, it is understood that the current fluctuation is such that the frequency f1 is about 3.8 times the frequency of 8.8 Hz at which the user feels most discomfortable about the flicker, i.e., is sufficiently high.

In the period R shown in (e) of part [B] of FIG. 4, the average target input electric power duty (=57.50%) is larger than the average target input electric power duty (=42.50%) in the case of the period P in (a) of part [A] of FIG. 4. For that reason, in the period R in (e) of part [B] of FIG. 4, different from the period P in (a) of part [A] of FIG. 4, the method in which the difference 412 is made small by causing the peak of AC flowing through the heat generating element 203 and the peak of the capacitor input current not to overlap with each other over the entire period R cannot be employed. Therefore, in the relationship between the current flowing through the heat generating element 203 and the capacitor input current, the entire section is divided into the two kinds of sections consisting of the current peak value overlapping section and the current peak value non-overlapping section, and these two sections are disposed sparsely. By this, the flicker is suppressed by setting the current peak value fluctuation frequency f1 at a high value. This is one of the features of the present invention. Incidentally, the table values of the electric power supply control table which is the table 1 may be constituted so that the current peak value fluctuation frequency f1 is made lower than 8.8 Hz, but in that case, one control cycle (8 half-waves in this embodiment) inevitably becomes long. As a result, a gain updating period (cycle) of the PID control becomes long, and a frequency of switching between a period of electric power supply to the heat generating element 203 and a period of electric power supply to the heat generating element 205 is reduced, so that inconveniences such that a temperature ripple of the heater 201 becomes light occur. For that reason, in practice, it is desirable that the constitution of this embodiment in which the flicker is suppressed by increasing the current peak value fluctuation frequency f1 in the period R in (e) of part [B] of FIG. 4 is employed.

Here, an 8-th half-wave section N which is the last section of the period R and a first half-wave section (N+1) which is the first section of the period S, which constitute a boundary between the period R in which the electric power is supplied to the heat generating element 203 and the period S in which the electric power is supplied to the heat generating element 205 will be described. From the viewpoint of the flicker suppression, in the section N and the section (N+1), a current peak value difference 413 between these two sections (FIG. 4[B](f)) may desirably be small. For that reason, in the section N, it is desirable that a peak value of a combined current of two currents consisting of the AC flowing through the heat generating element 203 and the capacitor input current is suppressed to a low level by causing the AC and the capacitor input current not to overlap with each other to the extent possible. Further, in the section (N+1), it is desirable that a peak value of a combined current of two currents consisting of the AC flowing through the heat generating element 205 and the capacitor input current is made high by causing the AC and the capacitor input current to overlap with each other to the extent possible. Thus, in the section N and the section (N+1), a manner of overlapping between the AC and the capacitor input current is optimized, and thus the current peak value difference 413 between the adjacent two sections can be suppressed to a small level, so that the flicker can be suppressed.

Incidentally, in this embodiment, a method in which the current peak value difference 413 is suppressed at a timing of transition from the period (period R) in which the electric power is supplied to the heat generating element 203 to the period (period S) in which the electric power is supplied to the heat generating element 205 was described. Also, as regards transition from the period of the electric power supply to the heat generating element 205 to the period of the electric power supply to the heat generating element 203, similarly, it is desirable that the manner of overlapping between the AC and the capacitor input current is optimized so that the current peak value difference during the switching between the heat generating elements becomes small.

[Electric Power Supply Control Table Applied to Heat Generating Element 203]

Next, the electric power supply control table which is the table 1 will be specifically described. First, the electric power supply control table shown as the table 1 is a table used in control of the electric power supply to the heat generating element 203, and is roughly constituted by three sections 1 to 3. The section 1 (first section) is a region in a range of 0.00% to 42.50% in average target input electric power duty. In the section 1, throughout entirety of the one control cycle (8 half-waves), phase control is carried out at a phase angle always equal to the average target input electric power duty.

In the range of the section 1 in which the average target input electric power duty of 0.00% to 42.50%, even when the control is carried out at the phase angle equal to the average target input electric power duty, a timing of a current peak of the AC flowing through the heat generating element 203 and a timing of a current peak of the capacitor input current do not overlap with each other. As a result, a peak value of a resultant current of the AC flowing through the heat generating element 203 and the capacitor input current does not become large. For that reason, as shown in (a) of part [A] of FIG. 4, the difference ΔI1 of the current peak value is decreased, so that the flicker suppression can be realized.

The section 2 (section 2) is a region in a range of 45.00% to 72.50%. In the section 2, in a relationship between a current waveform of the AC flowing through the heat generating element 203 and a current waveform of the capacitor input current, the entire section is divided into two kinds of sections in which peaks of the two current waveforms are caused to overlap with each other and are not caused to overlap with each other, and in an electric power supply control table, the two current peaks are sparsely dispersed. In the range of the section 2, throughout the entire control cycle, when the control is carried out at the phase angle equal to the average target input electric power duty, the overlapping between the current peak value of the AC flowing through the heat generating element 203 and the current peak value of the capacitor input current always occurs. For that reason, in the electric power supply control table of the section 2, as shown in (e) and (f) of part [A] of FIG. 4, the fluctuation frequency fl of the current peak is increased, so that the flicker suppression is realized.

The section 3 (third section) is a region in a range of 75.00% to 100.00% in average target input electric power duty. By using the electric power supply control table shown in the section 3, the current waveform of the AC supplied from the commercial AC power source 101 to the image forming apparatus 400 when the electric power is supplied to the heat generating element 203 is shown in (j) of part [C] of FIG. 4. In part [C] of FIG. 4, (j) is a waveform diagram showing a combined current waveform of a current waveform of the output supplied from the commercial AC power source 101 to the heat generating element 203 and a current waveform of the capacitor input current. In (j) of part [L] of FIG. 4, the current waveform in the former 8 half-waves is a current waveform when the electric power is supplied from the commercial AC power source 101 to the heat generating element 203 at the average target input electric power duty of 100%. The current waveform in the latter 8 half-waves is a current waveform when the electric power is supplied from the commercial AC power source 101 to the heat generating element 203 at the average target input electric power duty of 77.5%.

In the section 3, the average target input electric power duty is very high, and therefore, as in the section 2, in the relationship between the current waveform of the AC flowing through the heat generating element 203 and the current waveform of the capacitor input current, the section 3 cannot be divided into a section in which the two current waveforms overlap with each other and a section in which the two current waveforms do not overlap with each other. That is, the section 3 is a section in which throughout the entirety of one control cycle (8 half-waves), the current waveform of the AC flowing the heat generating element 203 and the current waveform of the capacitor input current inevitably overlap with each other. However, the average target input electric power duty in the section 3 is used only for several seconds when the heater 201 in a cool state is quickly warmed (for example, during actuation of the image forming apparatus 400). Further, during the actuation of the image forming apparatus 400, the electric power is not supplied to the heat generating element 205, and is supplied only to the heat generating element 203. This is because in the cool state of the heater 201, there is a need to uniformly and quickly warm the entirety of the heater 201, and therefore, it is required that the electric power is supplied only to the heat generating element 203 which is longer in longitudinal region in which the heat generates and which is large in heat generation angle.

In accordance with the average target input electric power duty in the section 3, in a state in which the electric power is supplied only to the heat generating element 203 during the actuation of the image forming apparatus 400, although the peak value of the AC is high, switching of the heat generating element to which the electric power is supplied is not made. For that reason, the fluctuation in AC does not so occur, and the flow hardly occurs.

As described above, the electric power supply control table shown as the table 1 applied to the heat generating element 203 is constituted by the three sections consisting of the sections 1 and 2 in which the flicker suppressing measures during heat generating element switching control have been taken and the section 3 in which the heat generating element switching control is not carried out. In the electric power supply control table shown as the table 1, in any section, the electric power duty values at which the flicker can be suppressed are set.

[Electric Power Supply Control Table Applied to Heat Generating Element 205]

Next, the electric power supply control table as the table 2 will be specifically described. The electric power supply control table shown as the table 2 is a table used in the control of the electric power supply to the heat generating element 205.

As described above, the resistance value of the heat generating element 205 is about 2.25 times the resistance value of the heat generating element 203. For that reason, a ratio of the peak value of the AC flowing through the heat generating element 205 to the peak value of the AC flowing through the heat generating element 203 in the case where the electric power duty is 100.00% is about 1/2.25. Therefore, in order to compensate for the peak value of the AC flowing through the heat generating element 204, it is desirable that a timing of the peak of the current waveform of the AC flowing through the heat generating element 205 and a timing of the peak of the current waveform of the capacitor input current are positively overlapped each other and thus a peak current value of a resultant current of these two currents is increased. For that reason, in the electric power supply control table as the table 2, in all the ranges from 0.00% to 100.00%, throughout the entirety of one control cycle (8 half-waves), the phase control is always carried out at the phase angle equal to the electric power duty. In a steady state of the image forming apparatus 400 (when the heater 201 is sufficiently warmed and image formation is continuously carried out), the electric power is supplied to the heat generating element 203 with the average target input electric power duty of about 40% to 50%. On the other hand, to the heat generating element 205 about 2.25 times larger in resistance value than the heat generating element 203, the electric power with the average target input electric power duty of about 90% to 100% is supplied. That is, a conduction angle of the AC flowing through the heat generating element 205 in the steady state of the image forming apparatus 400 is light, and therefore, a state in which the peak timing of the current in which of the AC flowing through the heat generating element 205 and the peak timing of the current waveform of the capacitor input current always overlap with each other is formed. That is, in the steady state, the peak timing of the contact waveform of the AC flowing through the heat generating element 205 and the peak timing of the current waveform of the capacitor input current always overlap with each other, whereby a peak value of a resultant current of these two currents can be always made light. By this, the difference between the current peak value in the period in which the electric power is supplied to the heat generating element 203 and the current peak value in the period waveform the electric power is supplied to the heat generating element 205 (the difference ΔI1 shown in part [A] of FIG. 4 and the difference ΔI2 shown in part [B] of FIG. 4) can be made small. As a result, an effect can be achieved in suppression of the flicker.

[Application of Electric Power Supply Control Table Depending on Recording Material Size]

In the above, the flicker suppression for the AC supplied from the commercial AC power source 101 to the image forming apparatus 400 was described using, as an example, the case where the image is formed on the A5-size recording material P (also referred to as the A5 sheet). In this embodiment, electric power supply control of the heat generating elements for a B5-size recording material P (also referred to as a B5 sheet), an A4-size recording material P (also referred to as an A4 sheet), and a LTR (letter) sheet will be described.

A table 3 shown below is a table showing correspondence between the kind of the recording material P on which the images formed (i.e., the sheet as an object on which the image is formed), the heat generating element used, and the electric power supply control table applied to the heat generating element used. Using the table 3, the electric power supply control tables used in the case where the images are formed on the LTR sheet, the A4 sheet, the B5 sheet, and the A5 sheet will be described.

TABLE 3

| KIND | TO 203*1 | T0 204*2 | T0 205*3 |
|---|---|---|---|
| LTR/A4 | Table 2 | —*4 | —*4 |
| B5 | Table 1 | Table 2 | —*4 |
| A5 | Table 1 | —*4 | Table 2 |

*1Control of electric power supply to the heat generating element 203.
*2Control of electric power supply to the heat generating element 204.
*3Control of electric power supply to the heat generating element 205.
*4No electric power supply.

In the case where the image is formed on the A5 sheet, as described above, for the heat generating element 203, the electric power supply control is carried out on the basis of the electric power supply control table which is the table 1, and for the heat generating element 205, the electric power supply control is carried out on the basis of the electric power supply control table which is the table 2. Incidentally, in the case where the image is formed on the A5 sheet, the heat generating element 204 is not used, and therefore, the electric power supply is not performed.

On the other hand, in the case where the image is formed on the B5 sheet, for the heat generating element 203, the electric power supply control is carried out on the basis of the electric power supply control table which is the table 1, and for the heat generating element 204, the electric power supply control is carried out on the basis of the electric power supply control table which is the table 1. Incidentally, in the case where the image is formed on the B5 sheet, the heat generating element 205 is not used, and therefore, the electric power supply is not performed.

Further, in the case where the images are formed on the A4 sheet and the LTR sheet, for the heat generating element 203, the electric power supply control is carried out on the basis of the electric power supply control table which is the table 2, and to the heat generating elements 204 and 205, the electric power is not supplied. In the case where the images are formed on the A4 sheet and the LTR sheet, the electric power is supplied to only the heat generating element 203, and therefore, the flicker occurring due to the difference in current peak value (the difference ΔI1 shown in part [A] of FIG. 4 and the difference ΔI2 shown in part [B] of FIG. 4) caused when an electric power supply passage to the heat generating element is switched does not occur. For that reason, in the case where the images are formed on the A4 sheet and the LTR sheet, it is only required that the flicker is cared only for the AC flowing through the heat generating element 203. The electric power supply control table in the section 2 of the table 1 includes the case where the peak timing of the current waveform of the AC flowing through the heat generating element 203 and the peak timing of the current waveform of the capacitor input current overlap with each other and the case where these peak timings do not overlap with each other, so that an unnecessary current change occurs. For this reason, from a viewpoint that the flicker is cared only for the AC flowing through the heat generating element 203, the unnecessary current change is caused, and therefore, is undesirable. For that reason, in the case where the images are formed on the A4 sheet and the LTR sheet, the electric power supply control for the heat generating element 203 is optimum when the electric power supply control is carried out on the basis of the electric power supply control table which is the table 2 than when the electric power supply control is carried out on the basis of the electric power supply control table which is the table 1.

Thus, in this embodiment, a reference electric power supply control table for the heat generating element 203 is used selectively between the case where the electric power supply passage is switched between the heat generating element 203 and another heat generating element (the heat generating element 204 or the heat generating element 205) and the case where the electric power is supplied only to the heat generating element 203. By this, even in either case, optimum control can be carried out from the viewpoint of the flicker suppression.

As described above, according to this embodiment, the flicker occurring due to the switching between the heat generating elements to which the electric power is supplied can be suppressed.

Embodiment 2

In the embodiment 1, the embodiment using the power source device for supplying the capacitor input current from the commercial AC power source was described. In an embodiment 2, an embodiment using a power source device including a PFC (Power Factor Correction) circuit will be described. Incidentally, a constitution of the image forming apparatus is similar to the constitution of the image forming apparatus according to the embodiment 1, and will be omitted from description by adding the same reference numerals or symbols to the same constituent elements of the image forming apparatus according to the embodiment 1.

[Heating Device]

FIG. 5 is a circuit diagram showing a circuit constituting of a heating device 100 of this embodiment and a power source device 300 which are included in the image forming apparatus 400 shown in FIG. 1. The circuit constitution of the heating device 100 shown in FIG. 5 is the same as the circuit constitution of the heating device 100 shown in FIG. 2, and will be omitted from description. On the other hand, the power source device 300 is different from the power source peak value 150 shown in FIG. 2 of the embodiment 2 in that a PFC (power factor improving circuit) 301 is provided between a diode bridge 151 and a primary smoothing capacitor 152, and another circuit constitution is similar to the circuit constitution of the power source device 150. The PFC circuit 301 includes a control circuit 305 for controlling an inductor 302, an FET 303, a diode 304 and a FET 303.

A circuit operation of the PFC circuit 301 is not a feature of the present invention, and therefore, details of the operation of the PFC circuit 301 will be omitted.

Part [A] of FIG. 6 includes waveform diagrams of a voltage waveform of an alternating voltage inputted from the commercial AC power source 101 to the image forming apparatus 400 (FIG. 6[A](i)) and an alternating current supplied from the commercial AC power source 101 to the power source device 300 (FIG. 6[A](ii)). In part [A] of FIG. 6, the ordinate of (i) represents a voltage, and the ordinate of (ii) represents a current value. In part [A] of FIG. 6, the abscissas of (i) and (ii) represent a time. In the power source device 300, the PFC circuit 301 is mounted, and therefore, the current waveform of the current supplied from the commercial AC power source 101 to the power source device 300 becomes a waveform having a sine wave shape as shown in (ii) of part [A] of FIG. 6. A circuit constitution of the power source device 300 other than the PFC circuit 301 is similar to the power source device 150 shown in FIG. 2 of the embodiment 1, and therefore will be omitted from description.

[Control of Electric Power Supply to Heat Generating Element]

Next, an operation of the heating device 100 in this embodiment in the case where the image is formed on the recording material P will be described using the A5-size recording material P as an example. As described above in the embodiment 1, in the case where the image is formed on the A5-size recording material P, the electric power is supplied from the commercial AC power source 101 to the heat generating elements 203 and 205 in the heating device 100. The electric power supply of the electric power to each of the heat generating elements 203 and 205 are controlled on the basis of an electric power supply control table shown in a table 4 appearing hereinafter.

The table 4 (depicted in FIG. 17) is the electric power supply control table to which reference is made in the case where the electric power is supplied to the heat generating element 203 through the first closed circuit, and in the case where the electric power is supplied to the heat generating element 205 through the second closed circuit.

The electric power supply control of the electric power supplied to the heat generating elements 203 and 205 on the basis of the electric power supply control table shown as the table 4 is carried out as shown at an upper portion of the table 4 in a manner similar to the manner in the embodiment 1 that 8 half-waves (4 periods) of the alternating voltage in which of the commercial AC power source 101 is used as one control cycle. On the other hand, numerical values shown at a lower portion of the table 4 show electric power duties, of electric power supplied to the heat generating element 203 or 205 in a period of each half-wave, with respect to an average target input electric power duty in one control cycle. Incidentally, details of a conduction start phase angle will be described later. Also, in this embodiment, similarly as in the embodiment 1, the electric power supply is carried out by dividing the electric power duty of the electric power capable of being supplied from the commercial AC power source to the heat generating element 203 or 205 into 40 stages (levels) with an increment of 2.50%. In the embodiment 1, in the electric power supply control of the electric power to the heat generating element 203 or 205 is carried out by making reference to different electric power supply control tables. In this embodiment, the electric power supply control table which is the table 4 is used commonly to the electric power supply control of the electric power to the heat generating element 203 and the electric power supply control of the electric power to the heat generating element 204 or 205.

[Waveform of Current Inputted from Commercial AC Power Source to Image Forming Apparatus]

Part [B] of FIG. 6 includes waveform diagrams showing current waveforms of alternating currents (ACs) supplied from the commercial AC power source 101 to the image forming apparatus 400. Specifically, part [B] of FIG. 6 includes the waveform diagrams showing the current waveforms of the alternating currents when the electric power is supplied to the heat generating element 203 in a period V and the current waveforms of the alternating currents when the electric power is supplied to the heat generating element 205 in a period W continuous to the period V. The period V is one control cycle including 8 half-waves in which the electric power is supplied to the heat generating element 203 via the first closed circuit and the period W is one control cycle including 8 half-waves in which the electric power is supplied to the heat generating element 205 via the second closed circuit.

In part [B] of FIG. 6, (b) shows the current waveform of the AC when the electric power with the average target input electric power duty of 57.50% is supplied from the commercial AC power source 101 to the heat generating element 203. In the case where the average target input electric power duty is 47.50%, the current waveform of the AC supplied form the commercial AC power source 101 to the heat generating element 203 has a waveform such that on the basis of the electric power control table which is the table 4, the current is always subjected to phase control with the electric power duty of 42.50% through entirety of one control cycle.

In part [B] of FIG. 6, (c) shows the current waveform of the AC when the electric power with the average target input electric power duty of 100.00% is supplied from the commercial AC power source 101 to the heat generating element 205. In the case where the average target input electric power duty is 100.00%, the current waveform of the AC supplied from the commercial AC power source 101 to the heat generating element 205 has a waveform such that on the basis of the electric power control table which is the table 4, the current is always subjected to phase control with the electric power duty of 100.00% through entirety of one control cycle.

In part [B] of FIG. 6, (d) shows the contact waveform of the AC supplied from the commercial AC power source 101 to the power source device 300. In the power source device 300, the PFC circuit 301 is mounted, and therefore, the current in which the AC supplied from the commercial AC power source 101 to the power source device 300 has a sine wave shape (Part [A] of FIG. 6).

In part [A] of FIG. 6, (a) shows a current in waveform of a current, supplied to the image forming apparatus 400, obtained by combining the three ACs shown in (b), (c) and (d). In the period V (the period in which the electric power is supplied from the commercial AC power source 101 to the heat generating element 203), both the AC supplied to the heat generating element 203 and the AC supplied to the power source device 300 are supplied from the commercial AC power source 101. For that reason, the current waveform in the period V becomes a current waveform obtained by combining these two ACs. On the other hand, in the period W (the period in which the electric power is supplied from the commercial AC power source 101 to the heat generating element 205), both the AC supplied to the heat generating element 205 and the AC supplied to the power source device 300 are supplied from the commercial AC power source 101. For that reason, the current waveform in the period W becomes a current in which obtained by combining these two ACs.

Here, the sine-wave-shaped AC supplied to the power source device 300 shown in (d) of part [B] of FIG. 6 is different from the capacitor input current shown in (d) of part [A] of FIG. 4, the AC always flows during the electric power supply from the commercial AC power source 101 to the power source device 300. Accordingly, different from the embodiment 1, a means for suppressing the flicker by a manner such that the peak of the current waveform of the AC flowing through each of the heat generating elements and the peak of the sine-wave-shaped current waveform of the AC supplied to the power source device 300 are not overlapped with each other cannot be employed. For that reason, in this embodiment, the flicker suppression is realized by controlling a current peak value of the AC itself flowing through each of the heat generating elements (the heat generating elements 203 and 205). In this embodiment, a synergistic effect is achieved by taking, into consideration, a relationship between a timing (phase angle timing of roughly 90 degrees and 280 degrees) of a peak value of the sine-wave-shaped AC supplied to the power source device 300 and the current waveform of the AC supplied to each of the heat generating elements.

A method of the flicker suppression in this embodiment will be described. In order to decrease a difference between the peak value of the AC in the period V and the peak value of the AC in the period W, the following method may desirably be employed. That is, in the period V of part [B] of FIG. 6, as regards the AC supplied from the commercial AC power source 101 to the heat generating element 203, the current peak value may desirably be minimized (lowered to the extent possible) by avoiding 90 degrees and 270 degrees which are phase angles at which the current peak value is largest (highest). By making the phase angle larger than 90 degrees or larger than 270 degrees, the peak value of the AC in the period V can be minimized (lowered to the extent possible).

On the other hand, in the period W of part [B] of FIG. 6, as regards the AC supplied from the commercial AC power source 101 to the heat generating element 205, the current peak value may desirably be maximized (increased to the extent possible) by including 90 degrees and 270 degrees which are phase angles at which the current peak value is largest (highest). That is, by making the phase angle not less than 0 degree and not more than 90 degrees or not less than 190 degrees and not more than 270 degrees, the peak value of the AC in the period W can be maximized (increased to the extent possible). Incidentally, at the phase angle of 90 degrees or 270 degrees which are phase angles at which the current values of the ACs flowing through the heat generating elements 203 and 205 become peaks, the current value of the sine-wave-shaped AC supplied to the power source device 300 also becomes substantially peak. Accordingly, the electric power supply to the heat generating element 203 while avoiding the phase angle of 90 degrees and 280 degrees and the electric power supply to the heat generating element 205 while including the phase angle of 90 degrees and 270 degrees are capable of achieving the following effect. That is, the effect such that the difference in peak value of the resultant current between the period V and the period W can be made smaller than the difference in current peak value between the heat generating element 203 and the heat generating element 205.

In part [B] of FIG. 6, the peak value of the AC flowing through the heat generating element 203 is defined as I203p (Figure [B](b)), and the peak value of the AC flowing through the heat generating element 205 is defined as I205p (FIG. 6[B](c)). Further, a difference in current peak value of the resultant current shown in (a) of part [B] of FIG. 6 between the period V and the period W is defined as ΔI4. Then, a relationship in magnitude between the peak values I203p and I205p, and the difference 414 is ((peak value I203p)−(peak value I205p))>(difference ΔI4). However, a timing when the peak value I203p is observed does not includes the phase angles of 90 degrees and 270 degrees. For that reason, at the timing when the peak value I203p is observed, an instantaneous current value Is203 of the AC (sine wave current) supplied to the power source device 300 is smaller than a peak current value Isp of the sine wave current ((instantaneous current value Is203)<(peak current value Isp)). Further, at a timing when the peak value I205p is observed, an instantaneous current value Is205 of the AC (sine wave current) supplied to the power source device 300 is equal to the peak current value Isp of the sine wave current ((instantaneous current value Is205)=(peak current value Isp)). As a result, a relationship in magnitude between the instantaneous current value Is203 and the instantaneous current value Is205 is ((instantaneous current value Is203) <(instantaneous current value Is205)).

[Electric Power Supply to Heat Generating Element with Use of Electric Power Supply Control Table]

As described above, when the electric power is supplied to the heat generating element 203, in order to carry out the electric power supply control for avoiding the phase angles 90 degrees and 270 degrees, the electric power supply control of the electric power supplied to the heat generating element 203 is carried out principally using the average target input electric power duty shown in the section 4 of the table 4. In the table 4, the section 4 includes a range of 0.00% to 47.50% in average target input electric power duty (unit: %). When the average target input electric power duty is 0.00%, an induction start phase angle (unit: deg) is 180 deg in the case of a positive half-wave and is 360 deg in the case of a negative half-wave. Incidentally, the section 4 does not include the average target input electric power duty of 50.00%, so that the phase angles of 90 deg and 270 deg are not included in the section 4, so that the conduction start phase angle is larger than 90 deg or 270 deg. Incidentally, the conduction start phase angle is about 180 deg (not more than 180 deg) in the case of the positive half-wave and is about 360 deg (not more than 360 deg) in the case of the negative half-wave.

On the other hand, when the electric power is supplied to the heat generating element 205, in order to carry out the electric power supply control for including the phase angles 90 degrees and 270 degrees, the electric power supply control of the electric power supplied to the heat generating element 205 is carried out principally using the average target input electric power duty shown in the section 5 of the table 4. In the table 4, the section 5 includes a range of 50.00% to 100.00% in average target input electric power duty (unit: %). When the average target input electric power duty is 50.00%, an induction start phase angle (unit: deg) is 90 deg in the case of a positive half-wave and is 270 deg in the case of a negative half-wave. For that reason, the conduction start phase angle is 90 deg or less or 270 deg or less. Further, when the average target input electric power duty of 100.00%, the conduction start is 0 deg in the case of the positive half-wave and is 180 deg in the case of the negative half-wave. Incidentally, the conduction start phase angle is about 180 deg in the case of the positive half-wave and is about 360 deg in the case of the negative half-wave.

As a means for principally using the section 4 of the table 4 in the control of the electric power supply to the heat generating element 203 and for principally using the section 5 of the table 4 in the control of the electric power supply to the heat generating element 205, a most simple and reliable method is such that restriction on a value of the average target input electric power duty is provided for each of the heat generating elements to which the electric power is supplied.

Specifically, whether or not the average target input electric power duty of the electric power supplied to the heat generating element 209 calculated through the PID control for a target temperature of the above-described heater 201 falls within the range of the section 4 of the table 4 is discriminated. Then, in the case where the calculated average target input electric power duty of the electric power supplied to the heat generating element 203 is out of the range of the section 4 of the table 4, the average target input electric power duty to be selected is set at 47.50% which is an upper limit of the section 4 in order not to include the phase angles 90 deg and 270 deg.

Also, as regards the control of the electric power supply to the heat generating element 205, similarly, the average target input electric power duty to be selected is set in the following manner. That is, in the case where the calculated average target input electric power duty of the electric power supplied to the heat generating element 205 is out of the range of the section 5 of the table 4, the average target input electric power duty to be selected is set at 50.00% which is a lower limit of the section 5 of the table 4. However, when the heater 201 which is cool during the actuation of the image forming apparatus 400 is quickly warmed, similarly as in the embodiment 1, the electric power is supplied only to the heat generating element 203, and at that time, the control of the electric power supply to the heat generating element 203 is carried out using the range of the electric power duty included in the section 5 of the table 4.

Thus, during the actuation of the image forming apparatus 400 (when the cool heater 201 is quickly warmed), the flicker can be suppressed by not switching the heat generating element. On the other hand, when in the steady state, the heater 201 is sufficiently warmed and the images are continuously formed on the recording materials P, in the case where the heat generating element to which the electric power is supplied is switched between the heat generating element 203 and another heat generating element (heat generating element 204 or heat generating element 205), section restriction shown in the table 4 is provided. By this, the flicker can be suppressed.

[Application of Electric Power Supply Control Table Depending on Recording Material Size]

In the above, the flicker suppression for the AC supplied from the commercial AC power source 101 to the image forming apparatus 400 was described using, as an example, the case where the image is formed on the A5-size recording material P (A5 sheet). In this embodiment, electric power supply control of the heat generating elements for a B5-size recording material P (B5 sheet), an A4-size recording material P (A4 sheet), and a LTR (letter) sheet will be described.

A table 5 shown below is a table showing correspondence between the kind of the recording material P on which the images formed (i.e., the sheet as an object on which the image is formed), the heat generating element used, and the electric power supply control table applied to the heat generating element used. Using the table 3, the electric power supply control tables used in the case where the images are formed on the LTR sheet, the A4 sheet, the B5 sheet, and the A5 sheet will be described.

TABLE 5

| KIND | TO 203*1 | T0 204*2 | T0 205*3 |
|---|---|---|---|
| LTR/A4 | Table 4 | —*4 | —*4 |
| B5 | Table 4*5 | Table 4 | —*4 |
| A5 | Table 4*5 | —*4 | Table 4 |

*1Control of electric power supply to the heat generating element 203.
*2Control of electric power supply to the heat generating element 204.
*3Control of electric power supply to the heat generating element 205.
*4No electric power supply.
*5Section restriction is provided.

In the case where the image is formed on the A5 sheet, as described above, for both the heat generating element 203 and the heat generating element 205, the electric power supply control is carried out by making reference to the electric power supply control table which is the table 4.

Incidentally, in the case where the image is formed on the A5 sheet, the heat generating element 204 is not used, and therefore, the electric power supply is not performed.

On the other hand, in the case where the image is formed on the B5 sheet, as described above, for both the heat generating element 203 and the heat generating element 204, the electric power supply control is carried out by making reference to the electric power supply control table which is the table 4. Incidentally, in the case where the image is formed on the B5 sheet, the heat generating element 205 is not used, and therefore, the electric power supply is not performed. In the case where the images are formed on the A5 sheet and the B5 sheet, in order to frequently switch the heat generating element to which the electric power is supplied, by performing the above-described section restriction of the average target input electric power duty of the electric power supplied to each of the heat generating element, the flicker suppression is realized.

Further, in the case where the images are formed on the A4 sheet and the LTR sheet, only for the heat generating element 203, the electric power supply control is carried out using the electric power supply control table which is the table 4. In the case where the images are formed on the A4 sheet and the LTR sheet, the electric power is supplied to only the heat generating element 203, and therefore, the flicker occurring due to the difference in current peak value caused when an electric power supply passage to the heat generating element is switched does not occur. For that reason, in the case where the images are formed on the A4 sheet and the LTR sheet, the electric power supply control table which is the table 4 can be used with no section restriction.

Thus, the section restriction shown in the table 4 is selectively used between the case where the heat generating element to which the electric power is supplied is switched between the heat generating element 203 and another heat generating element (heat generating element 204 or heat generating element 205) and the case where the electric power is supplied only to the heat generating element 203, whereby optimum control for suppressing the flicker can be carried out.

Incidentally, a feature of the present invention in this embodiment is that the phase angles of 90 deg and 270 deg are avoided (not included when the electric power is supplied to the heat generating element 203 and are included when the electric power is supplied to the heat generating element 205. Further, a method for realizing this feature is not limited to the above-described section restriction method shown in the table 4 in this embodiment. For example, a method, other than the section restriction method, in which a PID control gain during the electric power supply to the heat generating element 203 and a PID control gain during the electric power supply to the heat generating element 205 are changed or the like method would be also considered.

As described above, according to this embodiment, the occurrence of the flicker can be suppressed by switching the heat generating element to which the electric power is supplied.

Embodiment 3

In an embodiment 3, an embodiment in which the flicker suppression is performed by controlling electric power supply so that an average of a maximum current value for each of control cycles in a period in which the electric power is supplied to a heat generating element small in resistance value does not exceed a maximum current value in a period in which the electric power is supplied to a heat generating element small in resistance value does not exceed a maximum current value in a period in which the electric power is supplied to a heat generating element light in resistance value will be described. Incidentally, constituent elements of an image forming apparatus of this embodiment are similar to those of the image forming apparatus of the embodiment 1, and will be omitted from description by adding the same reference numerals or symbols to the same constituent elements.

[Control Block Diagram of Image Forming Apparatus]

FIG. 7 is a block diagram showing a control constitution of this embodiment relating to a fixing operation of the image forming apparatus 400 shown in FIG. 1, and the fixing operation of the image forming apparatus 400 will be described while making reference to FIG. 7. A PC 410 which is host computer sends a print instruction, including image data and print information of a print image, to a video controller 81 provided inside of the image forming apparatus 400.

When the video controller 81 receives the print instruction including the image data from the PC 410, the video controller 81 sends the print instruction to an engine controller 82. In the engine controller 82, a CPU 83, a memory 84, and the like are mounted, and the CPU 83 controls an image forming operation including the fixing operation in accordance with a program stored in the memory 84 in advance. Further, the CPU 83 includes a timer for measuring a time.

A fixing control device 56 is constituted by a triac 57 which is an electric power supply controller, a heat generating element switching device 58 (see FIG. 11) as a switching portion for selecting the heat generating element to which the electric power is supplied, and the like. The fixing control device 56 selects the heat generating element to which the electric power is to be supplied in the fixing device 50 and determines an electric power angle of the electric power to be supplied. Further, a driving device 85 is constituted by a main motor 86, a fixing motor 87, and the like. Further, a sensor 88 includes a fixing temperature sensor 59 which a temperature detecting unit for detecting a temperature of the fixing device 50, a sheet (paper) width sensor 89 for detecting a width of the recording material P, and the like, and a detection result of the sensor 88 is sent to the CPU 83. The CPU 83 controls the fixing control device 56 and the driving device 85 on the basis of the acquired detection result of the sensor 88, and thus carries out fixing of the transferred toner image onto the recording material P.

Incidentally, the image forming apparatus 400 to which the present invention is applied is not limited to the image forming apparatus 400 having the constitution described with reference to FIG. 1, and may only be required to be an image forming apparatus which is capable of printing images on recording materials P having different widths and which includes the fixing device 50 including a heater 54 described later.

[Fixing Device]

Next, a structure of the fixing device 50 for controlling a heating device (heater) for heating the toner image on the sheet (recording material) P by the heat generating element will be described using FIG. 8. Here, a "longitudinal direction" refers to a rotational axis direction of a pressing roller 53 substantially perpendicular to a feeding direction of the sheet P described later. Further, a length of the recording material P in a direction (longitudinal direction) substantially perpendicular to the feeding direction of the sheet P refers to as a sheet width.

FIG. 8 is a schematic sectional view for illustrating the structure of the fixing device 50. In the fixing device 50, the recording material P on which the (unfixed) toner image is carries is fed from a left-hand side in an arrow direction in FIG. 8 toward a fixing nip N constituted by contact between a fixing film 51 and the pressing roller 53. In the fixing nip N, the fixing film 51 is nipped by the pressing roller 53 and the heater 54. Further, the recording material P is heated while being fed from the left-hand side to a right-hand side in FIG. 8 in the fixing nip N, so that the toner image is fixed on the recording material P. The fixing device 50 is constituted by a cylindrical film 51, a nip forming member 52 for holding the film 51, the pressing roller 53 for forming the fixing nip N in cooperation with the film 51, and the heater 54 (heater portion) which is the heating device for heating the recording material P.

The film 51 is a fixing film as a rotatable heating member (first rotating member). The film 51 uses, for example, polyimide as a base layer, and on the base layer, an elastic layer formed of a silicone rubber and a parting layer formed of PFA are formed. In order to reduce a frictional force generated between the film 51 and each of the nip forming member 52 and the heater 54 by rotation of the film 51, grease is applied onto an inner surface of the film 51.

The nip forming member 52 not only guides the film 51 from an inside of the film 51 but also forms the fixing nip N between the film 51 and the pressing roller 53. The nip forming member 52 is a member having rigidity, a heat-resistant property, and a heat-insulating property and is formed of a liquid crystal polymer or the like. The film 51 is externally fitted to the nip forming member 52. The pressing roller 53 is a roller as a rotatable pressing member (second rotating member) and is constituted by a core metal 53*a*, an elastic member 53*b*, and a parting layer 53*c*. The pressing roller 53 is rotatably held at opposite end portions with respect to the longitudinal direction and is rotationally driven by a fixing motor 87 (FIG. 7), so that the film 51 is rotated by rotation of the pressing roller 53. The heater 54 which is a heating member is disposed in an inner space of the fixing film 51 and is held by the nip forming member 52, and contacts the inner surface of the film 51. Details of the heater 54 will be described.

[Heater]

Next, the heater 54 which is a heating portion will be described. FIG. 9 is a schematic view showing a structure of the heater 54 as viewed from the pressing roller 53 side shown in FIG. 8. In FIG. 9, a reference line a is a center line of heat generating elements 54*b*1*a*, 54*b*1, 54*b*2 and 54*b*3 with respect to the longitudinal direction and is also a center line of the sheet fed in the fixing nip N of the fixing device 50 with respect to the longitudinal direction (sheet width direction) of the sheet P. As shown in FIG. 9, the heater 54 includes a substrate 54*a*, the heat generating elements 54*b*1*a*, 54*b*1*b*, 54*b*2 and 54*b*3, a conductor 54*c*, contacts 54*d*1 to 54*d*4, and a protective glass layer 54*e*. The conductor 54*c* is a solid black portion in FIG. 9. As a material of the substrate 54*a* in this embodiment, alumina ($Al_2O_3$) which is ceramic is used.

As a ceramic substrate, those of the alumina ($Al_2O_3$), aluminum nitride (AlN), zirconia ($ZrO_2$), silicon carbide (SiC), and the like are well known, and among them, the alumina ($Al_2O_3$) is inexpensive and is readily available. Further, as a material of the substrate 54*a*, metal excellent in strength may be used. In the case where a metal substrate is used, as the material thereof, stainless steel (SUS) is excellent in cost and strength and is suitably used. Further, in the case where each of the ceramic substrate and the metal substrate has electroconductivity, an insulating layer is provided on the substrate and then may be used. On the substrate, the heat generating elements 54*b*1*a*, 54*b*1*b*, 54*b*2 and 54*b*3, the conductor 54*c*, and the contacts 54*d*1 to 54*d*4 are disposed, and in order to ensure insulation between the heat generating elements and the film 51, a protective glass layer 54*e* is coated on the heat generating elements, the conductor, and the contacts.

The respective heat generating elements are different in length in the longitudinal direction (left-right direction in FIG. 8), and with respect to the longitudinal direction, a length L1 of each of the heat generating elements 54*b*1*a* and 54*b* 1*b* is 222 mm, a length L2 of the heat generating element 54*b*2 is 188 mm, and a length L3 of the 54*b*3 is 154 mm. A relationship in magnitude between the lengths L1, L2 and L3 with respect to the longitudinal direction is L1>L2>L3.

For example, in the case where the sheet P for use is the A4 size, the heat generating elements 54*b*1*a* and 54*b* 1*b* are used. In the case where the sheet P for use is the B5 size, the heat generating element 54*b*2 is principally used. In the case where the sheet P for use is the A5 size, the heat generating element 54*b*3 is principally used. These heat generating elements are disposed in the order of the heat generating elements 54*b* 1*a*, 54*b*2, 54*b*3 and 54*b* 1*b* with respect to the widthwise direction (up-down direction in FIG. 9).

As shown in FIG. 9, the heat generating elements 54*b*1*a* and 54*b*1*b* are electrically connected to the contact 54*d*2 (first contact) at one end and to the contact 54*d*4 (fourth contact) at the other end via the conductor 54*c*. Further, the heat generating element 54*b*2 is electrically connected to the contact 54*d*2 at one end and to the contact 54*d*3 (third contact) at the other end via the conductor 54*c*. Similarly, the heat generating element 54*b*3 is electrically connected to the contact 54*d*1 (second contact) at one end and to the contact 54*d*3 at the other end via the conductor 54*c*. Incidentally, as shown in FIG. 9, the longitudinal length of each of the heat generating elements 54*b*1*a* and 54*b*1 is the substantially same length L1, and these two heat generating elements 54*b*1*a* and 54*b*1*b* are always used at the same time. In the following, the pair of the heat generating elements 54*b*1*a* and 54*b* 1*b* is referred to as a heat generating element 54*b*1 (first heat generating element). Further, as regards the resistance value of the heat generating element, the heat generating element 54*b*1 has a resistance value of 10Ω (combined resistance value of the heat generating elements 54*b* 1*a* and 54*b* 1*b*), the heat generating element 54*b*2 (third heat generating element) has a resistance value of 24Ω, and the heat generating element 54*b*3 (second heat generating element) has a resistance value of 24Ω.

In FIG. 9, a portion enclosed by a broken line represents a fixing temperature sensor 59. The broken line shows not only that the fixing temperature sensor 59 is disposed on a back surface of the substrate 54*a* (on a side opposite from the surface on which the heat generating elements 54*b*1, 54*b*2 and 54*b*3 are disposed) but also a position where the fixing temperature sensor 59 contacts the substrate 54*a*. The fixing temperature sensor 59 includes a thermistor 59*a* disposed on the center line of the heat generating elements 54*b*1, 54*b*2 and 54*b*3 with respect to the longitudinal direction and on the reference line a which is a center line of the sheet P fed to the fixing device 50.

[Heater]

FIG. 10 is a schematic view showing a cross section of the heater 54 when the heater 54 shown in FIG. 9 is cut along the center line (reference line a of FIG. 9) with respect to the longitudinal direction of the recording material P fed to the fixing device 50. The fixing temperature sensor 59 which is a temperature detecting unit for detecting the temperature of the heater 54 is constituted by the following members. That is, the fixing temperature sensor 59 is constituted by the thermistor 59*a*, a holder 59*b*, ceramic paper 59*c* for cutting off thermal conduction between the holder 59*b* and the thermistor 59*a*, and an insulating resin sheet 59*d* for physically and electrically protecting the thermistor 59*a*. The thermistor 59*a* is a temperature detecting element of which resistance value changes depending on the temperature of the heater 54 and of which voltage which is an output changes, and is connected to the CPU 83 by Dumet wire (not shown) and wiring and then outputs, to the CPU 83, the voltage depending on the temperature of the heater 54. The CPU 83 carries out temperature control of the heater 54 on the basis of a temperature detection result of the fixing temperature sensor 59 (thermistor 59*a*). The fixing temperature sensor 59 disposed on the surface opposite from the surface on which the heat generating elements 54*b*1, 54*b*2 and 54*b*3 covered with the protective glass layer 54*e* are disposed, and contacts the substrate 54*a*.

[Electric Power Control Circuit]

FIG. 11 is a schematic view showing structures of the fixing device 50 and the fixing control device 56. The fixing device 50 in this embodiment forms a desired temperature distribution of the heater 54 with respect to the longitudinal direction by switching the heat generating element, to which the electric power is supplied, depending on a size of the recording material P.

The fixing control device 56 of the fixing device 50 includes triacs 57*a* and 57*b* which are switching units for connecting and disconnecting the electric power supply passage, a heat generating element switching device 58, a triac state detecting portion 55, and a relay 70 for cutting off the electric power supply to all the heat generating elements. The triacs 57*a* and 57*b* connects and disconnects the electric power supply passage from the commercial AC power source 101 to the respective heat generating elements 54*b*1, 54*b*2 and 54*b*3. The heat generating element switching device 58 is constituted by a C contact relay 58 in this embodiment. Further, the triac state detecting portion 55 monitors an ON state and an OFF state of each of the triacs 57*a* and 57*b*.

The triac 57*a* (first switch) connects (ON state) or disconnects (OFF state) the electric power supply passage between the commercial AC power source 101 and the contact 54*d*4 of the heater 54. On the other hand, the triac 57*b* (second switch) connects (ON state) or disconnects (OFF state) the electric power supply passage between the commercial AC power source 101 and the contact 54*d*3 via the relay 58 or between the commercial AC power source 101 and the contact 54*d*1. The relay 58 (first relay) is capable of switching the contact 54*d*3 of the heater 54 so as to be connected to the commercial AC power source 101 via the triac 57*b* or the relay 70.

For example, in the case where the electric power is supplied from the commercial AC power source 101 to the heat generating element 54*b*1, the heater 54 and the contact 54*d*4 are connected to each other by turning on the triac 57*a*, and the triac 57*b* is turned off. By this, the heat generating element 54*b*1 (54*b* 1*a*, 54*b*1*b*) is connected to the commercial AC power source 101 via the contacts 54*d*2 and 54*d*4 of the heater 54. Further, in the case where the electric power is supplied from the commercial AC power source 101 to the heat generating element 54*b*2, the commercial AC power source 101 and the relay 58 are connected to each other by turning on the triac 57*b*, and the contact 54*d*3 of the heater 54 is connected to the triac 57*b* by controlling the relay 58, and the triac 57*a* is turned off. By this, one end of the heat generating element 54*b*2 is connected to the commercial AC power source 101 via the contact 54*d*3 of the heater 54, the relay 58, and the triac 57*b*, and the other end of the heat generating element 54*b*2 is connected to the commercial AC power source 101 via the contact 54*d*2 of the heater 54.

Further, in the case where the electric power is supplied from the commercial AC power source 101 to the heat generating element 54*b*3, the contact 54*d*3 of the heater 54 is connected to the commercial AC power source 101 by turning on the triac 57*b* and by controlling the relay 58, and the triac 57*a* is turned off. By this, one end of the heat generating element 54*b*3 is connected to the commercial AC power source 101 via the contact 54*d*3 of the heater 54 and the relay 58, and the other end of the heat generating element 54*b*3 is connected to the commercial AC power source 101 via the contact 54*d*1 of the heater 54 and the triac 57*c*. Incidentally, the ON/OFF operation of the triacs 57*a* and 57*b* is performed by an instruction (control signal) from the CPU 83.

The triac state detecting portion 55 detects the ON state and the OFF state of the triacs 57*a* and 57*b*. For example, in the case where the triacs 57*a* and 57*b* are simultaneously turned on due to unexpected failure of the CPU 83, or the like, the triac state detecting portion 55 sets a state of the triacs 57*a* and 57*b* in the OFF state, and forcedly cuts off the electric power supply from the commercial AC power source 101 to the fixing device 50 (heater 54). By this, a state in which only either one of the triacs 57*a* and 57*b* is put in the ON state or in which both of the triacs 57*a* and 57*b* are put in the ON state is ensured, so that failure of the fixing device 50 can be prevented.

Thus, the triacs 57*a* and 57*b*, the triac state detecting portion 55, and the relay 58 operate as a switching portion for switching connection of the electric power supply passage so that the electric power is supplied from the commercial AC power source 101 to one of the three heat generating elements 54*b*1, 54*b*2 and 54*b*3. In this embodiment, the switching portion having such a constitution was used, but it is only required that the electric power can be supplied to only either one of the heat generating elements, and the constitution of controlling the electric power supply passage is not limited to the above-described constitution.

Here, the recording material P shorter in longitudinal width than the heat generating element 54*b*3 is referred to as small-size paper, and the recording material P longer in longitudinal width than the heat generating element 54*b*2 is referred to as light-size paper. In the case where the image is printed on the light-size paper, only the heat generating element 541 is used in a fixing process. On the other hand, in the case where the image is printed on the small-size paper, from the viewpoint of deformation of the film 51, depending on the number of printing sheets, the heat generating elements 54*b*1 and 54*b*3 are alternately used in a switching manner. In this embodiment, a switching operation of the heat generating element 54*b* during continuous printing is performed in the case where images are continuously printed on the small-size papers for example.

[Electric Power Supply Control Method of Heat Generating Element]

An electric power supply control method of the electric power supplied to the heat generating element in this embodiment will be described. In this embodiment, the electric power is supplied to the heat generating element 54*b*1 (first heat generating element) for a certain period, and thereafter, the state is switched to a state in which the electric power can be supplied to the heat generating element 54*b*3 (second heat generating element) smaller in heat generation amount of a longitudinal end portion thereof than the heat generating element 54*b*1. At this time, an electric power supply period of the electric power to the heat generating element 54*b*1 is referred to as a first supply period. Simultaneous with an end of the first supply period, the electric power supply to the heat generating element 54*b*3 is started. The electric power supply to the heat generating element 54*b*3 is continued until an electric power supply amount of the electric power to the heat generating element 54*b*3 reaches a predetermined multiple of an electric power supply amount of the electric power to the heat generating element 54*b*1. At this time, an electric power supply period of the electric power to the heat generating element 54*b*3 is referred to as a second supply period. When the electric power supply amount of the electric power to the heat generating element 54*b*3 reaches the predetermined multiple of the electric power supply amount of the electric power to the heat generating element 54*b*1, the state is switched to a state in which the electric power can be supplied to the heat generating element 54*b*1, so that electric power supply to the heat generating element 54*b*1 is carried out again.

In this embodiment, in order to bring the temperature of the heat generating element 54*b* near to a target temperature, the electric power supply control is carried out so that a detection result of the thermistor 59*a* which is the temperature detecting unit is brought near to the target temperature. As the electric power supply control of the electric power to the heat generating element 54*b*, the electric power supplied to the heat generating element 54*b* is calculated every certain period depending on a difference between the target temperature of the heat generating element 54*b* and a detection temperature by the thermistor 59*a*. Specifically, on the basis of temperature information of the heater 54 detected by the thermistor 59*a*, the CPU 83 calculates an electric power amount necessary for that the temperature of the heater 54 reaches the target temperature suitable for formation of the image on the recording material P. The calculation of the electric power amount is performed every certain period. Further, in this embodiment, PI control is used for calculating the electric power amount, and a unit cycle of the electric power amount calculation in the PI control is 2 half-waves (corresponding to one cycle of the power source frequency of the commercial AC power source 101). This means that in the case where the power source frequency of the commercial AC power source 101 is 50 Hz, the electric power amount calculation control using the PI control is carried out every 20 msec (milliseconds).

In the PI control, every unit cycle, the CPU 83 compares the temperature detected by the thermistor with the target temperature and then carries out the electric power supply control on the basis of a difference between these two temperatures. The CPU 83 determines proportional and integral term depending on a magnitude of the difference between the two temperatures. The proportional is an output value proportional to the magnitude of the temperature difference, and the integral term is an output value depending on an integrated value of the temperature difference. On the basis of the value of the proportional and the value of the integral term, the CPU 83 determines a value of the electric power supplied to the heat generating element. In this embodiment, the proportional and the integral term are set for each of the heat generating elements, and the calculation of the electric power amount through the PI control is performed using the value of the proportional and the value of the integral term of the selected heat generating element.

Specifically, the PI control in this embodiment will be described. In the PI control, n is the number of a timing (cycle) when the PI control is carried out, the proportional corresponding to the timing number is Pn (unit: %), and the integral term corresponding to the timing number is In (unit: %). An electric power duty Dn (unit: %) of the electric power inputted to the heat generating element by the PI control is represented by the following three formulas (1) to (3).

$$Dn=Pn+In(100\%\geq Pn+Pn\geq 0\%) \quad (1)$$

$$Dn=100(Pn+In>100\%) \quad (2)$$

$$Dn=0(0\%>Pn+In) \quad (3)$$

Here, the electric power duty Dn represents an input proportion of the electric power amount determined by how many amount of the electric power is supplied for an AC voltage waveform of the commercial AC power source 101. The electric power duty Dn is capable of being a value from 0% to 100% depending on an electric power supply pattern determined by the phase control. The electric power supply pattern determined by the phase control is stored in advance in the memory 84 which is a storing portion. Depending on the electric power duty Dn, the CPV 83 selects the associated electric power supply pattern from the memory 84, and causes the commercial AC power source 101 to supply the electric power to the heat generating element depending on the selected electric power supply pattern.

When the printing of the image on the recording material P is started, first, an initial value I0 of an integral term I operated by integral control is determined. A table 6 below is a table showing the initial value I0 (unit: %) of the integral value I of each of the heat generating elements 54*b*1 and 54*b*3. As shown in the table 6, the initial value I0 for the heat generating element 54*b*1 is 32.5%, and the initial value I0 for the heat generating element 54*b*3 is 50%.

TABLE 6

| HGE*1 | 54b1 | 54b3 |
|---|---|---|
| I0 (%) | 32.5 | 50 |

*1"HGE" is the heat generating element.

Next, every 2-half-wave cycle (period) in the voltage waveform, the temperature of the heater 54 is detected by the thermistor 59*a*, a difference ΔT between the target temperature of the heater 54 and the temperature detected by the thermistor 59*a* is calculated. A table 7 appearing hereinafter is a table showing a value of the proportional Pn (unit: %) of each of the heat generating elements 54*b*1 and 54*b*3 corresponding to the calculated difference ΔT (unit: %). In the table 7, the value of each of the heat generating elements 54*b*1 and 54*b*3 every time when the difference ΔT from −15° C. to 15° C. changes by 1° C. is shown. For example, in the case where the difference ΔT between the two temperatures is −10° C., the proportional Pn of the heat generating element 54*b*1 is −27.5%, and the proportional Pn of the heat generating element 54*b*3 is −42.5%. Similarly, in the case where the difference ΔT between the two temperatures is 5° C., the proportional Pn of the heat generating element **54*b*1 is 15%, and the proportional Pn of the heat generating element 54*b*3** is 22.5%.

TABLE 7

| DF*1 ΔT | Pn [%] | |
|---|---|---|
| [° C.] | HGE*2 54b1 | HGE*2 54b3 |
| −15 | −40 | −60 |
| −14 | −37.5 | −57.5 |
| −13 | −35 | −52.5 |
| −12 | −32.5 | −50 |
| −11 | −30 | −45 |
| −10 | −27.5 | −42.5 |
| −9 | −25 | −37.5 |
| −8 | −22.5 | −35 |
| −7 | −20 | −30 |
| −6 | −17.5 | −25 |
| −5 | −15 | −22.5 |
| −4 | −12.5 | −17.5 |
| −3 | −10 | −15 |
| −2 | −7.5 | −10 |
| −1 | 0 | 0 |
| 0 | 0 | 0 |
| 1 | 0 | 0 |
| 2 | 7.5 | 10 |
| 3 | 10 | 15 |
| 4 | 12.5 | 20 |
| 5 | 15 | 22.5 |
| 6 | 17.5 | 25 |
| 7 | 20 | 30 |
| 8 | 22.5 | 35 |
| 9 | 25 | 37.5 |
| 10 | 27.5 | 42.5 |
| 11 | 30 | 45 |
| 12 | 32.5 | 50 |
| 13 | 35 | 52.5 |
| 14 | 37.5 | 57.5 |
| 15 | 40 | 60 |

*1"DF" is the difference.
*2"HGE" is the heat generating element.

Further, the CPU 83 causes the memory 84 to store an integrated value ΔTv obtained by integrating the difference ΔT between the temperatures calculated every 2 half-wave cycle. The CPU 83 calculates the integral term In with use of the following formula (4).

$$In = In-1 + \Delta I \quad (4)$$

For example, the integral value I1 is calculated by I1=I0+ΔI by using the above-described initial value I0 of the integral term In. Further, the value of ΔI changes depending on the integrated value ΔTr obtained by integrating the difference ΔT. A table 8 appearing hereinafter is a table showing the value of ΔI for each of the heat generating elements **54*b*1 and 54*b*3 depending on the integrated value ΔTv (unit: %). As shown in the table 8, in the case where the value of the integrated value ΔIv is −400 or more and less than 400, the value of ΔI for each of the heat generating elements 54*b*1 and 54*b*3 is 0%. In the case where the value of the integrated value ΔTv is 400 or more, the value of ΔI for the heat generating element 54*b*1 is 5% and the value of ΔI for the heat generating element 54*b*3 is 10%. Further, in the case where the value of the integrated value ΔTv is less than −400, the value of ΔI for the heat generating element 54*b*1 is −5%, and the value of ΔI for the heat generating element 54*b*3** is −10%.

TABLE 8

| IV*1 ΔTv | ΔI [%] | |
|---|---|---|
| [° C.] | HGE*2 54b1 | HGE*2 54b3 |
| 400≤ | 5 | 10 |
| −400 ≤ & < 400 | 0 | 0 |
| <−400 | −5 | −10 |

*1"IV" is the integrated value.
*2"HGE" is the heat generating element.

By the above-described process, the values of the proportional Pn and the integrated value In for each of the heat generating elements **54*b*1 and 54*b*3** are determined, and the electric power duty Dn is determined by the determined values of the proportional Pn and the integrated value In. Then, the electric power depending on the determined electric power duty Dn is supplied to the associated heat generating element. In this embodiment, determination of the above-described electric power duty Dn is performed in a 2-half-wave cycle, and electric power based on the determined electric power duty Dn is supplied in a subsequent 2-half-wave period. Further, the electric power depending on the electric power duty Dn is supplied to the heat generating element selected by the above-described switching portion. In this embodiment, a timing when the heat generating element to which the electric power is supplied is switched is caused to coincide with an updating timing of the PI control, i.e., a timing when the electric power duty Dn is updated.

[Control of Electric Power Supply to Heat Generating Element]

In this embodiment, electric power supply to the heat generating element **54*b*1 is controlled so that an average of a maximum current value for each control cycle in a first supply period for the heat generating element 54*b*1 small in resistance value does not exceed a maximum current value in a second supply period for the heat generating element 54*b*2 light in resistance value. A specific control method will be described using FIG. 12**.

In FIG. 12, a graph is shown on an upper side, and a table corresponding to the graph is shown on a lower side. The graph of FIG. 12 schematically shows a current amount of the current flowing through each of the heat generating elements **54*b*1 and 54*b*3, in which the abscissa represents a time and the ordinate represents a current value. The graph indicated by a broken line shows transition of the current value in the case where a supply electric power ratio (electric power duty) is 100%, and the graph indicated by a solid line shows transition of the current value in the case where control is carried out in a desired supply electric power amount. Further, the table shown below the graph shows items including a timing n, a supply electric power ratio (electric power duty), a maximum current value, a name of a period, a selected heat generating element to which the electric power is supplied, a comparison current value, which correspond to the time which is the abscissa of the graph. During continuous printing of images on the small-size paper, as shown in FIG. 12, the heat generating elements 54*b*1 and 54*b*3 are heated while alternately being switched. A switching timing of the heat generating element can be controlled variably depending on a warming state of constituent members of the fixing device 50**.

At a timing 1 (n=1) which is a first control cycle of the second supply period, the electric power is supplied to the heat generating element **54*b*3 at a supply electric power ratio (electric power duty "Duty") of 70%, and the maximum current value in the timing 1 is 7.1 A (ampere). This can be calculated from that the resistance value of the heat generating element 54*b*3 is 24Ω and that an effective voltage of the commercial AC power source 101 is 120 V. In this embodiment, the supply electric power ratio (electric power duty) is controlled by the ON state and the OFF state of the triacs 57***a* and 57*b*. When the states of the triacs 57*a* and 57*b* are set at the ON state once, the ON state is maintained until the alternating voltage (AC voltage) supplied from the commercial AC power source 101 becomes 0 V (zero crossing). For that reason, the supply electric power ratio of the electric power supply to the heat generating element is controlled by a waveform as shown in FIG. 12. That is, the supply electric power ratio is controlled by setting a latter half portion, at the ON state, until the AC voltage becomes the zero crossing in one-half-wave.

At a timing 2 (n=2) which is a subsequent control cycle, the supply electric power ratio ("Duty") is 40%, and the maximum current value in the timing 2 is 5.7 A. Thus, the electric power is supplied to the heat generating element 54*b*3 in a period corresponding to 4 unit cycles (n=1 to 4), and thereafter, destination of the electric power supply is switched to the heat generating element 54*b*1. Here, the maximum current value of the heat generating element 54*b*3 in the second supply period is 7.1 A. In this embodiment, when the supply electric power ratio ("Duty") in a subsequent first supply period of the electric power supply to the heat generating element 54*b*1 is determined, restriction is provided to the supply electric power ratio induced by the PI control so that a large current fluctuation does not occur between the first supply period and the second supply period. That is, at a timing 5 (n=5) which is a first control cycle of the first supply period, the electric power is supplied to the heat generating element 54*b*1 at the supply electric power ratio ("Duty") of 40%, and the maximum current value in the timing 5 is 7.2 A. At a timing 6 (n=6) which is a subsequent control cycle, the electric power is supplied to the heat generating element 54*b*1 at the supply electric power ratio ("Duty") of 30%, and the maximum current value in the timing 6 is 6.8 A. When an average of the maximum current values in the first supply period (n=5 and 6) is acquired, the average becomes 7.0 A, so that the average of 7.0 A is below the maximum current value of 7.1 A in the last second supply period (n=1 to 4).

Example of Control of Electric Power Supply to Heat Generating Element

Next, control of the electric power supply to the heat generating element during actual printing of the image on the recording material P will be described. A table 9 shown below is a table for illustrating how to determine an electric power amount of the electric power supplied to the heat generating element depending on a lapse of the time in the printing of the image on the recording material P in correspondence with the method described above with reference to FIG. 12.

TABLE 9

| Timing n | *** | 1 | 2 | 3 | 4 | 5 | 6 |
|---|---|---|---|---|---|---|---|
| Time (sec) | *** | 0.020 | 0.040 | 0.060 | 0.080 | 0.100 | 0.120 |
| TT*1 (° C.) | *** | 220 | 220 | 220 | 220 | 220 | 220 |
| TDV*2 (° C.) | *** | 216 | 222 | 222 | 218 | 218 | 218 |
| ΔT (° C.) | *** | 4 | −2 | −2 | 2 | 2 | 2 |
| ΔTv (° C.) | *** | 399 | 397 | 395 | 397 | 399 | 401 |

TABLE 9-continued

| Timing n | *** | 1 | 2 | 3 | 4 | 5 | 6 |
|---|---|---|---|---|---|---|---|
| | | | | | | | (=1) |
| SHGE*3 | *** | 54b3 | 54b3 | 54b3 | 54b3 | 54b1 | 54b1 |
| 54b1*4 P | *** | 12.5 | −7.5 | −7.5 | 7.5 | 7.5 | 7.5 |
| I | *** | 32.5 | 32.5 | 32.5 | 32.5 | 32.5 | 45 |
| Duty | *** | 45 | 25 | 25 | 40 | 40 | 52.5 |
| 54b3*5 P | *** | 20 | −10 | −10 | 10 | 10 | 10 |
| I | *** | 50 | 50 | 50 | 50 | 50 | 70 |
| Duty | *** | 74 | 40 | 40 | 60 | 60 | 80 |
| EPDIPI*6 | *** | 70 | 40 | 40 | 60 | 40 | 52.5 |
| AEPD*7 | *** | 70 | 40 | 40 | 60 | 40 | 30 |
| MCV*8 | *** | 7.1A | 5.7A | 5.7A | 7.1A | 7.2A | 6.8A |

The table 9 is constituted by the following items from above. That is, the table 9 is constituted by a timing n (corresponding to the timing n in FIG. 12), a time (unit: sec), a target temperature ("TT*1") (unit: ° C.), a thermistor detection value ("TDV*2) (unit: ° C.), a difference ΔT (unit: ° C.), an integrated value ΔTv (unit: ° C.), a selected heat generating element (SHGE*3) to which the electric power is supplied, an electric power supply result (proportional P, integral term I, Duty (electric power duty)) for the heat generating element 54*b*1 ("54*b*1*4"), an electric power supply result (proportional P, integral term I, Duty (electric power duty)) for the heat generating element 54*b*3 ("54*b*3*5"), electric power duty in the PI control ("EPDIPI*6"), an actual electric power duty ("AEPD*7"), and a maximum current value ("MCV*8").

For example, when the timing n is 5 (when the time is 0.100 sec), the thermistor detection value showing a detection temperature of the heater 54 by the thermistor 59*a* is 218° C., and the difference ΔT between itself and the target temperature of 220° C. is 2° C. (=220° C.−218° C.). Further, ΔTv showing an integrated value of the difference ΔT at this time is 399° C. (=397° C.+2° C.). In electric power calculation for the heat generating element 54*b*1, the proportional P in the case where the difference ΔT is 2° C. is 7.5% from the table 7, and the integral term I is I5=I0+ΔI=32.5% from the formula (4) since ΔI is 0% from the table 8. As a result, the electric power duty ("Duty") is 40% (=7.5%+32.5%). Similarly, in electric power calculation for the heat generating element 54*b*3, the proportional P in the case where the difference ΔT is 2° C. is 10.0% from the table 7, and the integral term I is I5=I4 (=I0)+ΔI=50% from the formula (4) since ΔI is 0% from the table 8. As a result, the electric power duty ("Duty") is 60% (=10.0%+50%). The selected heat generating element when the timing n is 5 is the heat generating element 54*b*1, and therefore, the electric power duty of the electric power actually supplied to the heater 54 is 40%, and the maximum current value at this time is 7.2 A.

Next, when the timing n is 6 (when the time is 0.120 sec), the thermistor detection value showing a detection temperature of the heater 54 by the thermistor 59*a* is 218° C., and the difference ΔT between itself and the target temperature of 220° C. is 2° C. (=220° C.−218° C.). Further, ΔTv showing an integrated value of the difference ΔT at this time is 399° C. (=397° C.+2° C.). However, from the above-described table 8, in the case where the integral value ΔTv is 400° C. or more, ΔI is not 0%, but is 5% in the case of the heat generating element 54*b*1 and is 10% in the case of the heat generating element 54*b*3. Further, when the integrated value ΔTv exceeds 400° C., the integrated value ΔTv is once reset. For that reason, the integrated value ΔTv is 1° C. (=401° C.−400° C.). In electric power calculation for the heat generating element 54*b*1, the proportional P in the case where the difference ΔT is 2° C. is 7.5% from the table 7, and the integral term I is I6=I5+ΔI=32.5%+5%=37.5% from the formula (4) since ΔI is 5% from the table 8. As a result, the electric power duty ("Duty") is 45% (=7.5+37.5%). Similarly, in electric power calculation for the heat generating element 54*b*3, the proportional P in the case where the difference ΔT is 2° C. is 10.0% from the table 7, and the integral term I is I6=I5+ΔI=50%+10%=60% from the formula (4) since ΔI is 10% from the table 3. As a result, the electric power duty ("Duty") is 70% (=10%+60%). The selected heat generating element when the timing n is 6 is the heat generating element 54*b*1, and therefore, the electric power duty of the electric power actually supplied to the heater 54 is 45%. In the case where the timing n is 6, as the heat generating element to which the electric power is supplied, the heat generating element 54*b*1 is selected by the switching portion, and an average of the maximum current values at the timing n=5 and the timing n=6 exceeds 7.1 A which is the maximum current value at the timings n=1 to 4 (second supply detect). For that reason, the electric power duty actually inputted to the heat generating element 54*b*3 is restricted to 30%. By this, the average of the maximum current values at the timings n=5 and n=6 can be suppressed to 7.0 A (=(7.2 A+6.8 A)/2) and thus can be made smaller than 7.1 A.

[Control of Amount of Electric Power Supplied to Heat Generating Element Small in Resistance Value]

In this embodiment, the electric power supply to the heat generating element 54*b*1 is controlled so that the average of the maximum current value for each control cycle of the first supply period in which the electric power is supplied to the heat generating element 54*b*1 small in resistance value does not exceed the maximum current value in the second supply period for the heat generating element 54*b*3 light in resistance value. FIG. 13 is a flowchart showing a control sequence for controlling the electric power amount of the electric power supplied to the heat generating element 54*b*1 small in resistance value. A process of FIG. 13 is actuated when a print job for printing the image on the recording material P is started, and is executed by the CPU 83 of the engine controller 82.

In a step S100, the CPU 83 performs PI calculation (calculation the electric power amount by the PI control) of the supply electric power ratio (electric power duty) of the electric power to the selected heat generating element. In S101, the CPU 83 discriminates whether or not the timing is a subsequent timing when a subsequent heat generating element to which the electric power is supplied is switched from the heat generating element 54*b*1 small in resistance value to the heat generating element 54*b*3 light in resistance value. In the case where the CPU 83 discriminated that the timing is the subsequent timing, the CPU 83 causes the process to go to S102. On the other hand, in the case where the CPU 83 discriminated that the timing is not the subsequent timing, the CPU 83 causes the process to go to S104.

In S102, the CPU 83 discriminates whether or not the average of the maximum current values for the heat generating element 54*b*1 when the electric power supply is performed by the PI calculation made in S100 is not more than the maximum current value for the heat generating element 54*b*3. In the case where the CPU 83 discriminated that the average of the maximum current values for the heat generating element 54*b*1 is the maximum current value or less for the heat generating element 54*b*3, the CPU 83 causes the process to go to S104. In the case where the CPV 83 discriminated that the average of the maximum current values for the heat generating element 54*b*1 is not the maximum current value or less for the heat generating element 54*b*3 (i.e., that the average of the maximum current values for the heat generating element 54*b*1 is larger than the maximum current value for the heat generating element 54*b*3, the CPU 83 causes the process to go to S103.

In S103, in order to restrict the electric power supplied to the heat generating element 54*b*1 so that the average of the maximum current values for the heat generating element 54*b*1 is the maximum current value or less for the heat generating element 54*b*3, the CPU 83 sets the electric power duty of the electric power to the heat generating element 54*b*1 at a reduced electric power duty value.

In S104, the CPU 83 determines the electric power amount of the electric power supplied to the selected heat generating element. In S105, the CPU 83 controls the fixing control device 56 depending on the supply electric power amount determined in S104, and causes the fixing control device 56 to supply the electric power to the selected heat generating element. In S106, the CPU 83 discriminates whether or not the print job is ended. In the case where the CPU 83 discriminated that the print job is ended, the process is ended, and in the case where the CPU 83 discriminated that the print job is not ended, the CPU 83 causes the process to return to S100.

Incidentally, a restricting value of the electric power supplied to the heat generating element 54*b*1 may be acquired by the calculation or may also be acquired by a method in which a table in which possible restricting values are collected is stored in the memory 84 in advance and in which the restricting value to be used is determined by making reference to the table as desired. Here, the method of acquiring the restricting value by the calculation.

In the second supply period, the maximum current value of the current flowing through the heat generating element light in resistance value is referred to as I_max, and the maximum current value of the current flowing through the heat generating element small in resistance value is referred to as I_max_small. Further, at the timing n=5 of the first supply period shown in FIG. 12, the maximum current value of the current flowing through the heat generating element 54*b*1 small in resistance value is referred to as L_1, and the electric power duty ("Duty") is referred to as Duty_1. Further, at the timing n=6 of the first supply period shown in FIG. 12, the maximum current value of the current flowing through the heat generating element 54*b*1 small in peak value is referred to as I_2, and the electric power duty ("Duty") is referred to as Duty_2. Further, the resistance value of the heat generating element 54*b*1 is referred to as R, and the effective voltage of the commercial AC power source 101 is referred to as V.

An average I_Arg_large of the maximum current value for each control cycle of the first supply period in which the electric power is supplied to the heat generating element 54*b*1 small in resistance value is represented by the following formula (5).

$$I_\text{Arg_large}=(I_1+I_2)/2 \tag{5}$$

Further, the electric power supply control of the electric power to the heat generating element in this embodiment is executed so as to satisfy the following formula (6).

$$I_\text{max}\geq I_\text{Arg_large}=(I_1+I_2)/2 \tag{6}$$

Here, when the current waveform of the commercial AC power source 101 is sine wave, the electric power duty Duty_1 of the electric power supplied to the heat generating element small in resistance value is shown as in FIG. 14. An area of a region enclosed by solid line and x-axis corresponds to Duty_1, and a region enclosed by a chain doubledashed line and the x-axis is drawn so that an area thereof equals to the area of the region enclosed by the solid line and the x-axis. Incidentally, in FIG. 14, the ordinate represents a current value, and the abscissa, represents a time.

In FIG. 14, Duty_1 equal to an integrated value of sin(x) from zero (0) to a desired time t, and the maximum current value I_1 at that time can be represented by sin(t)×I_max_small. Further, the maximum current value I_1 can be represented by the following formula (7) with use of formulas of cos(t)=1−Duty_1 and $\sin^2(t)+\cos^2(t)=1$.

$$\begin{aligned} I_1 &= \sin(t)\times I_max_small \quad \text{(formula 7)} \\ &= \left(\sqrt{(1-\cos^2(t))}\right)\times I_max_small \\ &= \left(\sqrt{(1-(1-Duty_1)^2)}\right)\times I_max_small \\ &= \left(\sqrt{(Duty_1\times(2-Duty_1))}\right)\times I_max_small \end{aligned}$$

Similarly, the maximum current value I_2 can be represented by the following formula (8).

$$I_1=(\sqrt{(Duty_2\times(2-Duty_2))})\times I_max_small \quad \text{(formula 8)}$$

As a result, it is only required that the electric power duties Duty_1 and Duty_2 are determined so that an average of the maximum current value I_1 represented by the formula (7) and the maximum current value I_2 represented by the formula (8) does not exceed the maximum current value I_max flowing through the heat generating element **54*b*3. By this, control can be carried out so that the average of the maximum current value for each control cycle of the first supply period in which the electric power is supplied to the heat generating element 54*b*1 small in resistance value does not exceed the maximum current value in the second supply period for the heat generating element 54*b*3** light in resistance value.

Thus, in this embodiment, the average of the maximum current values of the current flowing through the heat generating element **54*b*1 is restricted while changing a magnitude of the electric power supplied to the heat generating element through the PI control. The control and restriction of the electric power supplied to the heat generating element are carried out specification by changing a ratio of the electric power duty for controlling the electric power supply through the phase control, so that the temperature of the fixing device 50** is adjusted.

Further, in this embodiment, the PI control with 2 half-wave cycle was used, but an updating cycle and a control method of the PI control are not limited to those described above. Further, in this embodiment, a type in which a ratio of ON/OFF of the electric power supply is changed by the phase control was used, but an electric power restricting method is not limited thereto. For example, the electric power supply amount may be changed by restricting an amplitude of the current supplied from the commercial AC power source 101 by providing the current limiting circuit.

A table 10 appearing hereinafter shows maximum current values for the heat generating elements **54*b*1 and 54*b*3 in the case where the above-described control for suppressing the current value for the heat generating element 54*b*1 in this embodiment was carried out and in the case where the above-described control was not carried out. As shown in the table 10, in the case where the control for suppressing the current value for the heat generating element 54*b*1 was carried out, the maximum current value for the heat generating element 54*b*3 was 7.1 A and the maximum current value for the heat generating element 54*b*1 was 7.2 A. On the other hand, in the case where the control for suppressing the current value for the heat generating element 54*b*1 was not carried out, the maximum current value for the heat generating element 54*b*3 was 7.1 A and the maximum current value for the heat generating element 54*b*1** was 12 A. Thus, in the case where the above-described control in this embodiment was used, a current value change during the switching of the heat generating element is small, and in the case where the above-described control in this embodiment was not used, the current value change during the switching of the heat generating element is light, so that it is understood that a level of the flicker in the case where the control in this embodiment was carried out is improved compared with the case where the control in this embodiment was not carried out.

TABLE 10

| | MAXIMUM CURRENT VALUE | |
|---|---|---|
| HGE*[1] | EMB. 3 | NO CONTROL |
| 54b3 | 7.1A | 7.1A |
| 54b1 | 7.2A | 12A |

*[1]"HGE" is the heat generating element.

As described above, according to this embodiment, the flicker which can occur due to the switching of the heat generating element to which the electric power is supplied can be suppressed.

According to the present invention, it is possible to suppress the flicker which can occur due to the switching of the heat generating element to which the electric power is supplied.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a "non-transitory computer-readable storage medium") to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray disc (BD)), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-083234 filed on May 17, 2021, which is hereby incorporated by reference herein in its entirety.

What is claimed is:

1. An image forming apparatus comprising:

a first rotating member;

a heater which includes a first heat generating element and a second heat generating element larger in resistance value than said first heat generating element, which is provided in an inner space of said first rotating member, and which is configured to heat said first rotating member;

a second rotating member configured to form a nip in cooperation with said first rotating member;

a detecting unit configured to detect a temperature of said heater;

a switching unit configured to switch an electric power supply passage from an AC power source to said first heat generating element or said second heat generating element;

a controlling unit configured to control said switching unit so as to supply electric power to said first heat generating element or said second heat generating element; and a power source device configured to generate a DC voltage from an AC voltage supplied from the AC power source, wherein said first heat generating element, said second heat generating element, and said power source device are connected to the AC power source in parallel so that a first current is supplied from the AC power source to said first heat generating element, a second current is supplied from the AC power source to said second heat generating element, and a third current is supplied from the AC power source to said power source device, wherein on the basis of the temperature of said heater detected by said detecting unit and a target temperature of said heater, said controlling unit carries out control so that the electric power is supplied to said first heat generating element in a first period including a plurality of unit cycles through phase control and so that the electric power is supplied to said second heat generating element in a second period including a plurality of unit cycles through the phase control, wherein said switching unit switches the electric power passage so as to switch the first period to the second period or the second period to the first period, wherein in the first period, a resultant current of the first current and the third current is supplied to said first heat generating element, and the resultant current in at least one of the unit cycles of the first period is a current at which a timing when the first current is supplied and timings of a maximum and a minimum of the third current do not overlap with each other, and wherein in the second period, a resultant current of the second current and the third current is supplied to said second heat generating element, and the resultant current in at least one of the unit cycles of the second period is a current at which a timing when the second current is supplied and the timings of the maximum and the minimum of the third current overlap with each other.

2. An image forming apparatus according to claim 1, wherein said power source device includes a rectifying circuit configured to rectify the AC voltage supplied from the AC power source and a smoothing circuit configured to smooth the rectified AC voltage and wherein the third current is a current for charging a capacitor of said smoothing circuit.

3. An image forming apparatus according to claim 1, wherein in a first one of the unit cycles of the first period continuous to the second period, in the resultant current of the first current and the third current, the timing when the first current is supplied and the timings of the maximum and the minimum of the third current do not overlap with each other, and wherein a first one of the unit cycles of the second period continuous to the first period, in the resultant current of the second current and the third current, the timing when the second current is supplied and the timings the maximum and the minimum of the third current overlap with each other.

4. An image forming apparatus according to claim 3, wherein in the resultant current of the first current and the third current, the first period includes:

a first section including only the unit cycle in which the timing when the first current is supplied and the timings of the maximum and the minimum of the third current do not overlap with each other, a second section including the unit cycle in which the timing when the first current is supplied and the timings of the maximum and the minimum of the third current do not overlap with each other and the unit cycle in which the timing when the first current is supplied and the timings of the maximum and the minimum of the third current overlap with each other, and a third section including only the unit cycle in which the timing when the first current is supplied and the timings of the maximum and the minimum of the third current overlap with each other, and wherein said controlling unit selects either one of the first, second and third sections and controls said switching unit so as to supply the electric power to said first heat generating element.

5. An image forming apparatus according to claim 4, wherein in the second section, the unit periods in which the timing when the first current is supplied and the timings of the maximum and the minimum of the third current do not overlap with each other and the unit cycle in which the timing when the first current is supplied and the timings of the maximum and the minimum of the third current overlap with each other, are repeated.

6. An image forming apparatus according to claim 5, wherein said controlling unit selects the third section when said heater is quickly heated, and controls said switching unit so as to supply the electric power to said first heat generating element.

7. An image forming apparatus comprising:

a first rotating member;

a heater which includes a first heat generating element and a second heat generating element larger in resistance value than said first heat generating element, which is provided in an inner space of said first rotating member, and which is configured to heat said first rotating member;

a second rotating member configured to form a nip in cooperation with said first rotating member;

a detecting unit configured to detect a temperature of said heater;

a switching unit configured to switch an electric power supply passage from an AC power source to said first heat generating element or said second heat generating element;

a controlling unit configured to control said switching unit so as to supply electric power to said first heat generating element or said second heat generating element; and a power source device configured to generate a DC voltage from an AC voltage supplied from the AC power source, wherein said first heat generating element, said second heat generating element, and said power source device are connected to the AC power source in parallel, wherein on the basis of the temperature of said heater detected by said detecting unit and a target temperature of said heater, said controlling unit determines an electric power amount per unit cycle of the electric power supplied to said first heat generating element and said second heat generating element, wherein in a first period in which the electric power is supplied to said first heat generating element through phase control, a first current such that a phase angle at which conduction is started is larger than 90 degrees and a phase angle at which the conduction is ended is smaller than 180 degrees or such that the phase angle at which the conduction is started is larger than 270 degrees and the phase angle at which the conduction is ended is smaller than 360 degrees is supplied to said first heat generating element, and wherein in a second period which is continuous to the first period and in which the electric power is supplied to said second heat generating element through the phase control, a second current such that a phase angle at which the conduction is started is 0 degrees or more and 90 degrees or less and a phase angle at which the conduction is ended is 180 degrees or less or such that the phase angle at which the conduction is started is 180 degrees or more and 270 degrees or less and the phase angle at which the conduction is ended is 360 degrees or less is supplied to said second heat generating element.

8. An image forming apparatus according to claim 7, wherein said power source device includes a rectifying circuit configured to rectify the AC voltage supplied from the AC power source and a smoothing circuit configured to smooth the rectified AC voltage, and wherein a power-factor improving circuit is connected to between said rectifying circuit and said smoothing circuit.

9. An image forming apparatus according to claim 8, wherein in the first period, the first current is supplied from the AC power source to said first heat generating element and the third current is supplied to said power source device, and wherein in the second period, the second current is supplied from the AC power source to said second heat generating element and the third current is supplied to said power source device.

10. An image forming apparatus according to claim 9, wherein said controller controls said switching unit so that in a case that an angle at which conduction when the electric power is supplied to said first heat generating element is started is 90 degrees or less or 270 degrees or less, the first current such that the angle at which conduction is started is larger than 90 degrees and the angle at which the conduction is ended is smaller than 180 degrees or such that the angle at which the conduction is started is larger than 270 degrees and the angle at which the conduction is ended is smaller than 360 degrees is supplied to said first heat generating element, and in a case that the angle at which the conduction when the electric power is supplied to said second heat generating element is larger than 90 degrees or larger than 270 degrees, the second current such that an angle at which the conduction is started is 0 degrees or more and 90 degrees or less and the angle at which the conduction is ended is 180 degrees or less or such that the angle at which the conduction is started is 180 degrees or more and 270 degrees or less and the angle at which the conduction is ended is 360 degrees or less is supplied to said second heat generating element.

11. An image forming apparatus according to claim 10, wherein said controller controls said switching unit so that in a case that said heater is quickly heated, the first current such that the angle at which the conduction is started is 0 degrees or more and 90 degrees or less and the angle at which the conduction is ended is 180 degrees or less or such that the angle at which the conduction is started is 180 degrees or more and 270 degrees or less and the angle at which the conduction is ended is 360 degrees or less is supplied.

12. An image forming apparatus according to claim 1, wherein said first heat generating element is longer than said second heat generating element in a longitudinal direction, wherein said heater further includes a third heat generating element shorter than said first heat generating element and longer than said second heat generating element in the longitudinal direction, wherein said first heat generating element comprises a pair of heat generating elements having the substantially same length in the longitudinal direction, and wherein with respect to a widthwise direction of a substrate including said heater, one of said pair of heat generating element, said second heat generating element, said third heat generating element, and the other of said pair of heat generating elements are arranged in a named order.

13. An image forming apparatus according to claim 7, wherein said first heat generating element is longer than said second heat generating element in a longitudinal direction, wherein said heater includes a third heat generating element shorter than said first heat generating element and longer than said second heat generating element in the longitudinal direction, wherein said first heat generating element comprises a pair of heat generating elements having the substantially same length in the longitudinal direction, and wherein with respect to a widthwise direction of a substrate including said heater, one of said pair of heat generating element, said second heat generating element, said third heat generating element, and the other of said pair of heat generating elements are arranged in a named order.

14. An image forming apparatus according to claim 12, wherein said heater includes:

a first contact where one end of said first heat generating element and one end of said second heat generating element are electrically connected to each other, a second contact to which one end of said third heat generating element is connected, a third contact where the other end of said second heat generating element and the other end of said third contact are connected to each other, and a fourth contact to which the other end of said first heat generating element is connected.

15. An image forming apparatus according to claim 14, wherein said switching unit includes a first switch, a second switch, and a relay, wherein said first switch carries out connection or disconnection between the AC power source and said fourth contact, wherein said second switch carries out connection or disconnection between the AC power source and said relay and between the AC power source and said second contact, and wherein said relay is capable of switching connection between said second switch and said third contact or connection between the AC power source and said third contact.

16. An image forming apparatus according to claim 15, wherein each of said first switch and said second switch is a bidirectional thyristor.

17. An image forming apparatus according to claim 1, wherein said first rotating member is a cylindrical film, wherein said second rotating member is a pressing roller for forming a nip in cooperation with said film, and wherein said heater is provided in an inner space of said film and sandwiches said film by itself and said pressing roller, and an image on a recording material is heated through said film in the nip.

18. An image forming apparatus according to claim 7, wherein said first rotating member is a cylindrical film, wherein said second rotating member is a pressing roller for forming a nip in cooperation with said film, and wherein said heater is provided in an inner space of said film and sandwiches said film by itself and said pressing roller, and an image on a recording material is heated through said film in the nip.

* * * * *